US005321425A

United States Patent [19]

Chia et al.

[11] Patent Number: 5,321,425

[45] Date of Patent: Jun. 14, 1994

[54] RESOLUTION INDEPENDENT SCREEN REFRESH STRATEGY

[75] Inventors: Wei K. Chia; Bor C. Kuo, both of Hsinchu; Jiunn M. Ju, Tainan; Gen H. Chen; Chih U. Liu, both of Hsinchu, all of Taiwan

[73] Assignee: Industrial Technology Research Institute, Hsinchu, Taiwan

[21] Appl. No.: 839,535

[22] Filed: Feb. 19, 1992

[51] Int. Cl.[5] ..... G09G 1/02

[52] U.S. Cl. ..... 345/200; 345/203

[58] Field of Search ..... 340/799, 798, 750, 800, 340/723; 365/230.03, 230.04, 230.05, 230.09, 222; 395/164, 165, 166

[56] References Cited

U.S. PATENT DOCUMENTS

| | | | |
|---|---|---|---|
| 4,562,435 | 12/1985 | McDonough et al. | 340/799 |
| 4,684,942 | 8/1987 | Nishi et al. | 340/701 |
| 4,855,959 | 8/1989 | Kobayashi | 365/230.09 |
| 5,001,672 | 3/1991 | Ebbers et al. | 365/230.04 |
| 5,065,369 | 11/1991 | Toda | 365/230.05 |
| 5,179,372 | 1/1993 | West et al. | 340/799 |

OTHER PUBLICATIONS

Texas Instruments, MOS Memory Data Book: Commercial and Military Specifications (1991), 8-3 to 8-72.

*Primary Examiner*—Alvin E. Oberley
*Assistant Examiner*—Regina Liang
*Attorney, Agent, or Firm*—Meltzer, Lippe, Goldstein et al.

[57] ABSTRACT

A controller and method for refreshing a display device with data linearly stored in a video memory having a row addressable memory array and serial access memory are disclosed. The circuit for controlling the video memory includes a row address generator for addressing a row of data in the memory array. A circuit is provided for initiating a split row transfer of a half addressed row of the memory array to the corresponding half of the serial access memory while data are shifted out of the other half of the serial access memory. A tap pointer generator is also provided to alternatively point to the different halves of the memory array rows.

11 Claims, 14 Drawing Sheets

60

RESOLUTION INDEPENDENT SCREEN REFRESH STRATEGY

RELATED CASE

The following related cases have been filed and assigned to the assignee hereof: "Architecture for a Window-Based Graphics System", filed Nov. 25, 1991, Ser. No. 07/796,720, applicants: Wei Kuo Chia, Bor Chuan Kuo, Jin Min Jue, Gen Kong Chen; "Address Processor Unit for a Graphics Controller," filed Nov. 25, 1991, Ser. No. 07/796,719, applicants: Wei Kuo Chia, Bor Chuan Kuo, Jin Min Jue, Gen Kong Chen; and "Resolution Independent Raster Display System," filed Oct. 7, 1991, Ser. No. 07/772,710, applicants: Wen-Jann Yang, Chih-Yuan, Bor Chuan Kuo.

FIELD OF THE INVENTION

The present invention relates to a video display system which makes efficient use of memory capacity and which is resolution independent.

BACKGROUND OF THE INVENTION

The raster scan display is commonly utilized both in computer systems and in commercial televisions. An image displayed on the screen comprises an array of pixels arranged in rows and columns. The screen is usually refreshed sequentially scan line by scan line from top to bottom. Presently, the refresh rate is usually not lower than 30 Hz. A frame buffer stores the screen refresh pixel data. When any pixel datum in the frame buffer is updated, the screen is refreshed, and the corresponding pixel on the screen is changed.

FIG. 1 schematically illustrates a conventional raster display system. The display system 10 is utilized to display an image on the CRT screen 12. Pixel data which is displayed on the screen 12 is stored in a frame buffer 14. In the conventional display system 10 of FIG. 1, the frame buffer 14 is a dynamic RAM (DRAM).

When the host computer 16 is ready to refresh the DRAM 14, an address is sent to the DRAM 14 from the host computer 16 via the address bus 15 and the multiplexer (MUX) 18. Data to be entered in the DRAM is sent from the host computer 16 to the random access port 20 of the DRAM 14 via the bus 30. Additionally, host access control signals are sent via line 8 to a memory controller circuit 7 which transmits various control signals, such as CAS, RAS, etc., via line 9 to the DRAM 14.

To perform a screen refresh operation, an address is sent from the graphic controller 22 to the DRAM 14 via the bus 17 and the multiplexer 18. The pixel data to be transmitted to the screen 12 in the screen refresh operation is read out of the DRAM 14 at the random access port 20 and is transmitted via the bus 30 to the shift register 24 which serves as a parallel-to-serial converter. The data is converted from digital to analog form using the Digital-to-Analog converter (DAC) 26 and then transmitted to the screen 12. The timing of the shift register 24 is controlled by a video timing signal generated by the graphic controller 22 and transmitted to the shift register 24 via the line 19. The graphic controller 22 is connected to the host computer 16 via the bus 11 and also generates the vertical synchronization signal (VSYNC), the horizontal synchronization signal (HSYNC) and the horizontal and vertial blanking signals which are transmitted via lines 21 to the screen 12 and the DAC 26.

The display system 10 of FIG. 1 has a significant disadvantage. The major problem is that the bus 30 leading to and from the random access port 20 is utilized to receive data from the host computer 16 for frame buffer refresh and to transmit data to the screen 12 for screen refresh. As is known, an increase in screen resolution will increase the time required to refresh the screen. When the required time to refresh the screen reaches a certain level, the host computer 16 will not be able to gain control over the bus 30 and random access port 20 to perform frame buffer refresh operations. This conflict over use of the random access port 20 and bus 30 results in a decrease in the efficiency of operation of the display system.

One way to avoid this kind of conflict is to implement the frame buffer as a video RAM (VRAM) instead of a simple DRAM. A 256K*4 VRAM 40 is illustrated in FIG. 2. The VRAM 40 of FIG. 2 comprises a DRAM array 42 having 512 columns and 512 rows. The VRAM 40 has both a random access port 44 and a serial port 45. The serial port 45 is illustratively formed by a serial access memory (SAM) 46 implemented with a shift register. An entire row of data from the DRAM 42 is transferred to the SAM 46 via lines 47A, 47B and transfer pass gate 43 by an operation which is called a read data transfer (RDT). When a read data transfer operation is carried out, a row of data of the DRAM 42 is transferred to the SAM 46. Thereafter, the data of the SAM 46 may be serially shifted out of the I/O port 49. This is achieved by means of a serial counter 48 which receives a serial clock (SC) as an input. The serial counter increments with each clock of the serial clock thereby outputting a different pixel datum from the SAM 46. Alternatively, the serial counter 48 includes a pointer which points to a starting location in the SAM 46. In this mode of operation, data is serially shifted out of the SAM 46 starting at the location pointed to by this pointer. Illustratively, a TMS44C250 VRAM manufactured by Texas Instruments operates in a fashion similar to the VRAM 40 of FIG. 2.

FIG. 3 illustrates a video display system 10'. The system 10' of FIG. 3 is similar to the system 10 of FIG. 1. The differences are that the frame buffer is now implemented by the VRAM 40 instead of the DRAM 14 as in FIG. 1. In addition, the parallel-to-serial converter 24 is eliminated. In the system 10' of FIG. 3, a frame buffer refresh operation transfers data from the host computer 16 to the random access port 44 of the VRAM 40 via the bus 47. On the other hand, to carry out a screen refresh operation, data is transferred from the serial port 45 in bits-serial format (e.g., 4-bit wide serial format) to the DAC 26 for conversion to analog form for refreshing the display on the screen 12. In the display system 10', the serial clock for use by the serial port 45 of the VRAM 40 is supplied by the graphic controller 22 via the line 48.

In short, in the system 10' of FIG. 3, frame buffer refresh operations and screen refresh operations take place via different ports and utilize different buses, so that the two processes are isolated from each other. Therefore, conflict between the two types of operations over access to the random port 20 and bus 30 of FIG. 1 are substantially resolved.

The problem with the system 10' of FIG. 3 is that the VRAM 40 utilized therein makes very inefficient use of memory capacity. This is illustrated through use of the following example. Consider the case where the screen 12 has a resolution of 900 scan lines with 1152 pixels per scan line. The pixels in each scan line of the display screen are labeled 0,1, . . . , 1151. The scan lines are labeled 1, . . . , 900. The memory arrays of a 256*4 VRAM for storing one 900*1152 frame of pixels for a screen with this format are illustrated in FIG. 4.

The memory capacity of FIG. 4 is divided into two banks, labeled BANK 1 and BANK 2. Each bank comprises four memory arrays. The memory arrays of BANK 1 are labeled VRAM0, VRAM1, VRAM2, VRAM3. Similarly, the memory arrays of BANK 2 are labeled VRAM0,VRAM1,VRAM2,VRAM3. Each memory array is $2^9 \times 2^9$ which means that it has 512 rows and 512 column locations per row. Every column location of each row may store the datum of one pixel. The 512 rows of each memory array are labeled 0,1, . . . , 511 in FIG. 4. In this memory arrangement, each row of the VRAMs, VRAM0, VRAM1, VRAM2, VRAM3 is used to store one scan line of the display. The 512 columns of each memory array are labeled 0,1, . . . , 511 in FIG. 4.

The pixels 0, . . . , 1151 of scan line 1 of one frame for the screen 12 are stored in the memory arrays of FIG. 4 as follows. Every fourth pixel starting from 0, i.e. pixels, 0,4,8, . . . , 1148 of scan line 1 of the display screen frame occupy column locations 0,1, . . . , 287 of row 0 of the first memory array VRAM0 in BANK 1. Every fourth pixel starting from 1, i.e. pixels 1,5,9, . . . , 1149 of scan line 1 of the display screen frame occupy column locations 0,1, . . . , 287 of row 0 of the second memory array VRAM1 in BANK 1. Similarly, every fourth pixel starting from 2, i.e., pixels 2,6,10, . . . 1150 of scan line 1 of the display screen frame occupy column locations 0,1, . . . , 287 of row 0 of the third memory array VRAM2 of BANK 1. Finally, pixels 3,7,11, . . . , 1151 of scan line 1 of the display screen frame occupy column locations 0,1, . . . , 287 of row 0 of the fourth memory array VRAM3 of BANK 1.

In a similar manner, pixels 0,4,8, . . . , 1148 of scan line 2 of the display screen frame occupy column locations 0,1, . . . , 287 of row 1 of memory array VRAM0 of BANK 1. Pixels 1,5,9, . . . , 1149 of scan line 2 of the display screen frame occupy column locations 0,1, . . . , 287 of row 1 of memory array VRAM1 of BANK 1, and so on. Thus, the pixels of scan lines 1, . . . , 512 of the display screen frame occupy positions 0,1, . . . , 287 of rows 0,1, . . . , 511 of the memory arrays VRAM0, VRAM1, VRAM2, VRAM3 of BANK 1.

Scan lines 513,514, . . . , 900 of the display screen frame occupy positions 0,1, . . . , 287 of rows 0,1, . . . , 387 of the memory arrays VRAM0, VRAM1, VRAM2, VRAM3 of BANK 2 in a fashion similar to the storage in BANK 1. For instance, scan line 513 of the display screen frame is stored on row 0 of the memory arrays VRAM0, VRAM1, VRAM2, VRAM3 of BANK 2. Pixels 0,4,8, . . . , 1148 are stored in locations 0,1, . . . , 287 of row 0 of the first memory array VRAM0 of BANK 2. .Pixels 1,5,9, . . . , 1149 are stored in locations 0,1, . . . , 287 of row 0 of the second memory array VRAM1 of BANK 2, and so on. As can be seen from FIG. 4. 50.6% of the space in the VRAMs is unused.

Data is transmitted to the screen 12 of FIG. 3 from the memory of FIG. 4 as follows. To display scan line 1 of the display screen, during a vertical blanking interval, the row 0 of each memory array VRAM0, VRAM1, VRAM2, VRAM3 in BANK 1 is transferred to the SAM 46 (FIG. 2) in a read data transfer (RDT) operation. The data in the serial port, from locations 0,1, . . . , 287 is then transferred in bits-serial format to the screen. During the horizontal blanking interval following the display of the scan line 1 of the display screen, the pixel data in row 1 of each memory array VRAM 0, VRAM1, VRAM2, VRAM3 in BANK 1 is transferred to the SAM 46 (FIG. 2). The data stored at positions 0,1, . . . , 287 in the SAM 46 (FIG. 2) are then transferred serially to the screen to refresh scan line 2 of the screen display. Then scan lines 3,4, . . . , 512 of the screen display are refreshed in the same manner. The process continues until the scan line 513 of the display screen is refreshed. At this point, row 0 of each memory array VRAM0, VRAM1, VRAM2, VRAM3 in BANK 2 is transferred to the SAM 46 (FIG. 2) and the data of positions 0,1, . . . , 287 are serially transferred to the display screen. Then, scan lines 514, . . . , 900 of the display screen may be refreshed in a similar manner.

Alternatively, the pixel data may be stored in a special memory storage arrangement if a VRAM with split row transfer is used. A VRAM 60 with split transfer capability is illustrated in FIG. 5A. The VRAM 60 comprises a memory array, such as DRAM 62, which illustratively has 512 rows×512 columns. The columns are labeled near the top of FIG. 5A. The VRAM 60 includes a random access port 64 through which pixels may be written into the DRAM 62. The VRAM 60 also has a serial port 65 with split row transfer capability. Thus, the serial port 65 can perform both conventional read data transfer (RDT) operations and split row transfer operations. In a read data transfer, the SAM 66 acts as single shift register unit. A row of the DRAM 62 is addressed by loading a row address into the row address register 127. The gate units 67 and 68 are simultaneously enabled so that an entire addressed row of 512 pixels is transferred to the SAM 66. Pixels are transmitted serially via the serial I/O 73, starting at the position of column 0 in the SAM 66, synchronously with the serial counter 74. The outputted pixel data appear on line 75.

In a split row transfer operation, the SAM 66 is split into two halves 66A, 66B. The lower half 66A contains bit positions 0,1, . . . , 255 and the upper half **66*b* contains bit positions 256, 257, . . . , 511. In the case of a split row transfer only one of the gate units 67 or 68 is enabled so that only the upper half or the lower half of the VRAM 60 row addressed by the row address register 127 is transferred, respectively, to the upper half or the lower half of the SAM 66. A split row transfer operation makes use of the tap pointer implemented by the transfer control logic circuit 71. When a split read transfer cycle is initiated, the half of the SAM 66 pointed to by the tap pointer (i.e. upper or lower half) is loaded with the corresponding half row of data of the DRAM 62 currently addressed by the row address register 127. It should be noted that in a split row transfer operation, data may be transferred into one half of the SAM 66, while data is being read out of the other half. An example of a VRAM 60** with split row transfer capability is the TMS44C251 available from Texas Instruments.

As with the VRAM 40 (FIG. 3), the serial counter 74 has an input for receiving a starting location pointer for the serial output of the SAM 66. By means of this pointer, the SAM 66 will begin shifting out the pixel data from the location specified by this pointer. Thus, the serial output of the SAM 66 can be controlled to skip over selected pixel data.

Also depicted in FIG. 5A is a serial I/O control circuit 76. This circuit receives an input labeled SE which serves to enable or disable the I/O circuit 73. Thus, the serial output of the VRAM 60 may be selectively shut off.

FIG. 5B illustrates a special arrangement for storing the scan lines of pixel data of a 900*1152 display screen using 256K*4 VRAMs 60 (FIG. 6) which may execute a split row transfer. Here only one bank of 4 memory arrays, designated VRAM0, VRAM1, VRAM2, VRAM3, is used. As before, the display screen scan lines are labeled 1,2, . . . , 900, and the column locations within each scan line are labeled 0,1, . . . , 1151. The VRAM rows are labeled 0,1, . . . , 511 and the column locations of each row are labeled 0,1, . . . , 511.

The rows of each memory array VRAM0,VRAM1,-VRAM2,VRAM3 are divided in half. The lower half of each array row, i.e., locations 0,1, . . . , 255, is used for storing the first 1024 pixel data of the odd scan lines of the display screen. The upper half, i.e. locations 256,257, . . . , 511 is used for storing the first 1024 pixel data of the even scan lines of the display screen.

The storage of the pixels is as follows. The first 1024 pixels, i.e. 0,1, . . . , 1023, of scan line 1 of the display screen are stored in column positions 0,1, . . . , 255 of row 0 of the memory arrays VRAM0, VRAM1, VRAM2, VRAM3. As before, every fourth pixel from 0, i.e. 0,4, 8, . . . , 1020 is stored in locations 0,1, . . . , 255 of row 0 of the first memory array VRAM0. Likewise, every fourth pixel from 1, i.e. 1,5,9, . . . , 1021 of the display screen is stored in locations 0,1, . . . , 255 of row 0 of the second array VRAM1. Every fourth pixel from 2, i.e. 2,6,10, . . . , 1022 is stored in locations 0,1, . . . , 255 of the third array VRAM2. Finally, every fourth pixel from 3, i.e. 3,7,11, . . . , 1023 is stored in locations 0,1, . . . , 255 of the fourth array VRAM3.

The first 1024 pixels of the remaining odd scan lines 3,5, . . . , 899 of the display screen are stored in column positions 0,1, . . . , 255 of the four memory arrays VRAM0, VRAM1, VRAM2, VRAM3 in a similar fashion. In other words, the first 1024 pixels of the odd scan lines occupy the lower half of the rows 0,1, . . . , 449 of the four memory arrays VRAM0, VRAM1, VRAM2, VRAM3.

The last one hundred twenty-eight pixels of each odd display screen scan line, i.e. pixels 1024,1025, . . . , 1151, are stored in the upper half of the bottom rows, i.e. 511,510, . . . , 454 of the memory arrays VRAM0, VRAM1, VRAM2, VRAM3. Pixels 1024,1028, . . . , 1048 of scan line 1 of the display screen are stored in column locations 256,257, . . . , 289 of row 511 of the first memory array VRAM0. Pixels 1025,1029, . . . , 1049 of scan line 1 of the display screen are stored in column locations 256,257, . . . , 289 of row 511 of the second memory array VRAM1. Pixels 1026,1030, . . . , 1050 of scan line 1 of the display screen are stored in column locations 256,257, . . . , 289 of row 511 of the third memory array VRAM2. Finally, pixels 1027,1031, . . . , 1051 of scan line 1 of the display screen are stored in column locations 256,257, . . . , 289 of row 511 of the fourth memory array VRAM3.

In a similar fashion, the last one hundred twenty-eight pixels of the third display screen scan line are stored in the thirty-two column locations adjacent the last 128 pixels of the first scan line, i.e. locations 290,291, . . . , 321. Thus, the last one hundred twenty-eight pixels of scan lines 1,3,5,7,9,11,13,15 of the display screen are stored in the upper half of row 511 of the memory arrays VRAM0, VRAM1, VRAM2, VRAM3. Scan lines 17,19,21,23,25,27,29,31 of the display screen are stored in the upper half of row 510 of the memory arrays VRAM0, VRAM1, VRAM2, VRAM3. In this fashion, the last one hundred twenty-eight pixels of each odd display screen scan line are stored in the upper half of the memory arrays VRAM0, VRAM1, VRAM2, VRAM3 from row 511 to row 454.

The storage of the even scan lines of pixels of the display screen is as follows. Pixels 0,1, . . . , 1023 of scan line 2 of the display screen are stored in column positions 256,257, . . . , 511 of row 0 of the four memory arrays VRAM0, VRAM1, VRAM2, VRAM 3 in a fashion similar to row 1 of the display screen. That is, pixels 0,4,8, . . . , 1020 of scan line 2 of the screen display are stored in row 0, positions 256,257, . . . , 511 of the first memory array VRAM0. Pixels 1,5,9, . . . , 1021 of scan line 2 of the screen display are stored in row 0, positions 256,257, . . . , 511 of the second memory array VRAM1. Pixels 2,6,10, . . . , 1022 of scan line 2 of the display screen are stored in row 0, positions 256,257, . . . , 511 of the third memory array VRAM2. Finally, pixels 3,7,11, . . . , 1023 of scan line 2 of the display screen are stored in row 0, positions 256,257, . . . , 511 of the fourth memory array VRAM3.

The first 1024 pixels of each even scan line 2,4,6, . . . , 900 of the display screen are stored in column positions 256,257, . . . , 511 of the four memory arrays VRAM0, VRAM1, VRAM2, VRAM3 in a similar fashion. In other words, the first 1024 pixels of the even scan lines occupy the upper half of the rows 0,1, . . . , 449 of the four memory arrays VRAM0, VRAM1, VRAM2, VRAM3.

The last one hundred twenty-eight pixels of each even display screen scan line, i.e. pixels 1024,1025, . . . , 1151 are stored in the lower half of the bottom rows 511,510, . . . , 454 of the memory arrays VRAM0, VRAM1, VRAM2, VRAM3. Pixels 1024,1028, . . . , 1148 of scan line 2 of the display screen are stored in column locations 0,1, . . . , 31 of row 511 of the first memory array VRAM0. Pixels 1025,1029, . . . , 1149 of scan line 2 of the display screen are stored in column locations 0,1, . . . , 31 of row 511 of the second memory array VRAM1. Pixels 1026,1030, . . . , 1150 of scan line 2 of the display screen are stored in column locations 0,1, . . . , 31 of row 511 of the third memory array VRAM2. Finally, pixels 1027,1031, . . . , 1151 of scan line 2 of the display screen are stored in column locations 0,1, . . . , 31 of row 511 of the fourth memory array VRAM3.

In a similar fashion, the last one hundred pixels of the fourth scan line of the display screen are stored in the thirty-two column locations adjacent the last one hundred twenty-eight pixels of the scan line 2, i.e. locations 32,33, . . . , 63. Thus, the last one hundred twenty-eight pixels of scan lines 2,4,6,8,10,12,14,16 of the display screen are stored in the lower half of row 511 of the memory arrays VRAM0, VRAM1, VRAM2, VRAM3. Scan lines 18,20,22,24,26,28,30,32 of the display screen are stored in the lower half of row 510 of the memory arrays VRAM0, VRAM1, VRAM2, VRAM3. In this fashion, the last one hundred twenty-eight pixels of each even display screen scan line are stored in the lower half of the memory arrays VRAM0, VRAM1, VRAM2, VRAM3 from row 511 to row 454.

The screen refresh operation is slightly different than with the example of FIG. 4 before. To display scan line 1 of the display screen, a split row transfer is executed to move the lower half of row 0 of the DRAM 62 (FIG. 5A) into the SAM 66 (FIG. 5A). Thus, after this transfer, the SAM 66 (FIG. 5A) stores the first 1024 pixels of scan line 1 in its lower half. While the data of this half row is serially outputted from the VRAM 60 (FIG. 5A), another split row transfer is performed to move the data of the upper half of row 511 of the DRAM 62 (FIG. 5A) into the SAM 66 (FIG. 5A), including the last one hundred twenty-eight pixels of scan line 1. Thus, after the lower half row is outputted from the SAM 66 (FIG. 5A), the serial counter pointer may be set to point to the location in the SAM 66 of the first of the last one hundred twenty-eight pixels. The last one hundred pixels of scan line 1 of the display screen may thereafter be serially outputted from the VRAM 60 (FIG. 5A).

After the display of display screen scan line 1, a horizontal blanking interval occurs. The upper half of row 0 of the DRAM 62 (FIG. 5A) (containing the first 1024 pixels of display screen scan line 2) is transferred, Via a split row transfer to the upper half of the SAM 66 (FIG. 5A). The serial counter pointer is set to point to the first pixel datum of the upper half and pixels are shifted out of the SAM (FIG. 5A). While pixel data are serially shifted out of the upper half of the SAM 66 (FIG. 5A) a split row transfer is performed to move the last one hundred twenty-eight pixels of display screen scan line 2 from the lower half of DRAM 62 (FIG. 5A) row 511 to the lower half of the SAM 66 (FIG. 5A). Again, after pixel 1024 of the display screen row is shifted out, the serial counter pointer may be set to point to the location of the first of the one hundred twenty-eight pixels in the lower half of the SAM 66 (FIG. 5A). The last one hundred twenty-eight pixels of scan line 2 may then be shifted out. This process continues for all of the display screen scan lines.

As can be seen, the circuit of FIG. 5B uses much of the VRAM 60 (FIG. 5) without wasting space. However, the display of pixels on the display screen is highly complex. The complexity increases for displays of dimensions not divisible by 32, or displays having odd dimensions.

In view of the foregoing, it is an object of the present invention to provide a display system which makes more efficient use of memory resources.

It is also an object of the invention to provide a video display system whose structure is independent of a specific screen resolution.

It is a further object of the invention to provide a video display system which is adaptable to any screen resolution without complicated circuitry.

SUMMARY OF THE INVENTION

The present invention is a video display system which makes efficient use of memory capacity and which is resolution independent, i.e., which operates with a wide variety of screen resolutions.

The inventive display system makes use of a special type of VRAM which performs an operation known as a split row transfer. In a split row transfer operation, one-half of a VRAM row can be transmitted to the serial access memory (SAM) which forms the serial port without interfering with the other half of the VRAM row. The SAM of this type of VRAM can be viewed as comprising two half rows, with a tap pointer for pointing to one of the two halves. In a split row transfer operation, a half row of data, corresponding to the half pointed to by the tap pointer, is transferred from the DRAM of the VRAM to the half of the SAM pointed to by the tap pointer.

When this type of VRAM is utilized, it is now possible to store the pixels of each row of the display screen one right after another in the DRAM of the VRAM. Again, four VRAMs may be used to store the pixel data with pixels 0,4,8, . . . in the first VRAM, pixels 1,5,9, . . . in the second VRAM, etc. Storage in the first VRAM, as with the other VRAMs, uses all available space. For instance, for a display screen with 1280 scan lines (labeled 1,2, . . . , 1280) and 1600 pixels per scan line (labeled 0,1, . . . , 1599), pixels 0,4,8, . . . , 1596 of scan line 1 may be stored in row 0, columns 0, . . . , 399 of the DRAM of the first memory array. The pixels of scan line 2 of the display screen may be stored in the remaining portion of row 0 and continue onto row 1 of the DRAM of the first memory array. In other words, pixels 0,4,8, . . . , 444 of scan line 2 of a display screen may be stored in row 0, columns 400, . . . , 511 of the first memory array. Pixels 448,452, . . . , 1596 of scan line 2 of the display screen may be stored in row 1, columns 0, . . . , 287 of the DRAM of the first memory array. The third scan line of the display may be stored in row 1, columns 288, . . . , 511 and row 2, columns 0, . . . , 275, and so on. Such a storage scheme is referred to as linear addressing. Linear addressing, in contrast to the other storage schemes, does not waste any memory space in the VRAM.

In the inventive display system, frame buffer refresh operations take place through a random access port of the VRAM. Screen refresh operations take place through the serial port with split row transfer capability.

In a split row transfer operation, one-half of the addressed VRAM row of pixel data is transferred to the respective half of the SAM. For example, a VRAM may have 512 column locations labeled 0,1, . . . , 511 for storing pixel data and a SAM having 512 locations labeled 0,1, . . . , 511. A split row transfer of the lower half of the VRAM transfers the pixel data of locations 0,1, . . . , 255 to locations 0,1, . . . , 255 of the SAM. Similarly, a split row transfer of the upper half of the VRAM transfers the pixel data of locations 256, 257, . . . , 511 to locations 256, 257, . . . , 511 of the SAM.

The inventive display system comprises a unique screen refresh controller. The screen refresh controller has a first counter for counting the locations in the SAM for storing pixel data and a second counter for counting the rows of the DRAM of the VRAM. The first counter is initialized to zero at the end of a vertical blanking interval and counts in sequence with the pulses of the serial clock up to the number of pixels in a row of the VRAM. Illustratively, the serial clock is synchronized to the serial clock signal of the VRAM.

The second counter is also initialized to zero at the end of the vertical blanking interval. Once during the lower half of the counter's count, i.e., before the first counter exceeds the midpoint of its count, the second counter is incremented. Illustratively, for a 512×512 pixel VRAM, the second counter is incremented every time the first counter reaches 127.

Additionally, the controller has a tap pointer generator for alternatively pointing to the upper and lower half of the SAM. The tap pointer is toggled to point to the upper half of the SAM while the first counter counts in the lower half of its count. Further, the tap pointer is toggled to point to the lower half of the SAM while the first counter counts in the upper half of its count. To achieve this, the complement of the highest order bit of the first counter is illustratively fed to the tap pointer input of the VRAM for use by the tap pointer therein.

Finally, the controller also includes a refresh request generator for initiating a transfer cycle. The refresh request generator initiates a split row transfer of each half of the VRAM row addressed by the second counter during the vertical display interval. A split row transfer of the lower half of the VRAM row addressed by the second counter occurs once while the first counter counts in the upper half of its count for each row of the VRAM. Similarly, a split row transfer of the upper half of the VRAM row addressed by the second counter occurs once, for each row of the VRAM, while the first counter counts in the lower half of its count. Illustratively, for a 512×512 VRAM, a split row transfer on the lower half of an addressed row (i.e., columns 0,1, . . . , 255) occurs when the first counter reaches 256. A split row transfer on the upper half of an addressed row (i.e. columns 256, 257, . . . , 511) occurs when the first counter reaches 512. In addition, the refresh request generator also generates a request during the vertical retrace interval for initiating a read transfer cycle such that the first row of data in the DRAM of the VRAM can be transferred into the SAM.

DETAILED DESCRIPTION OF THE INVENTION

Figure 1:
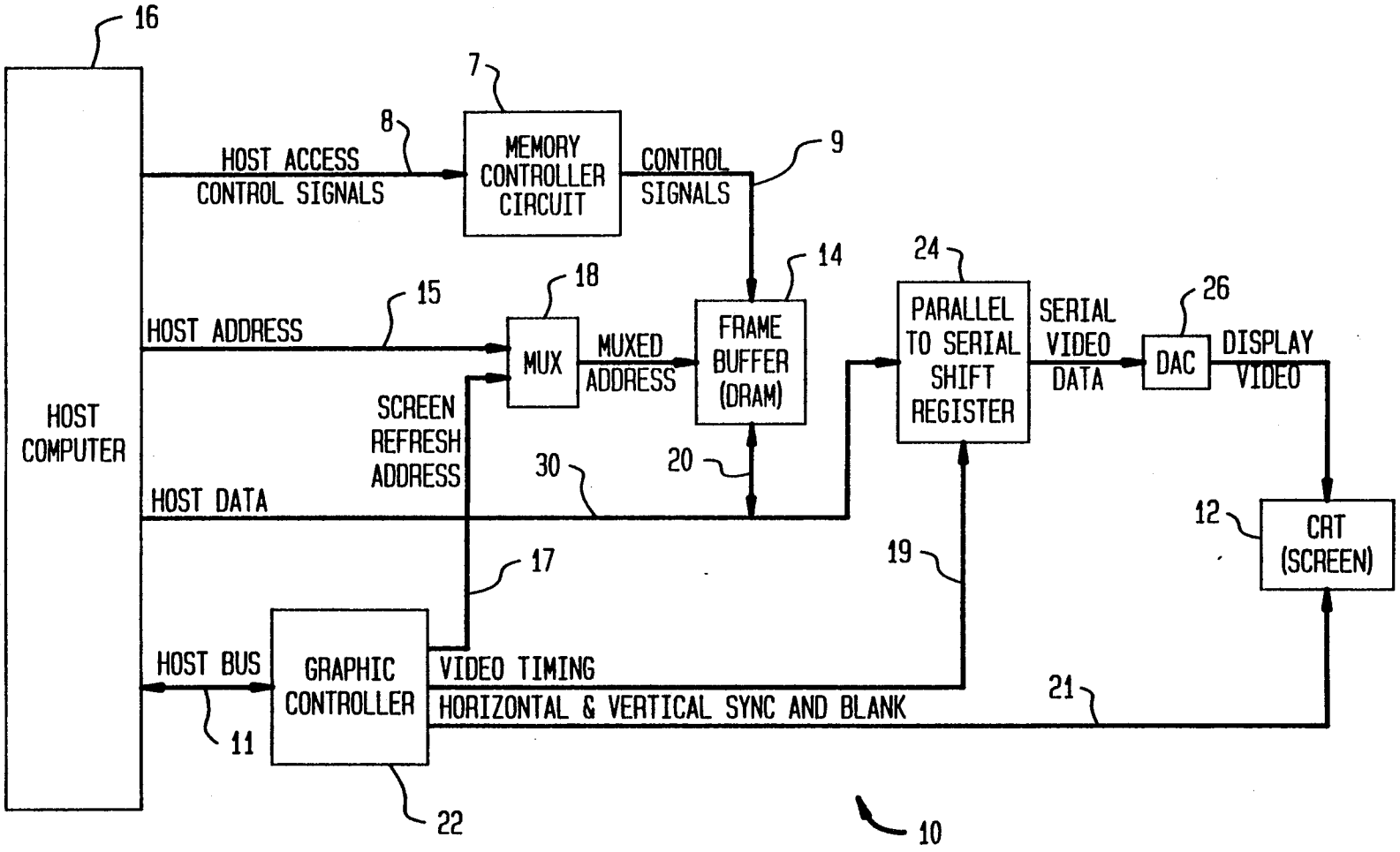
FIG. 1 schematically illustrates a conventional raster display system in which the frame buffer is implemented using DRAMs.
Figure 2:
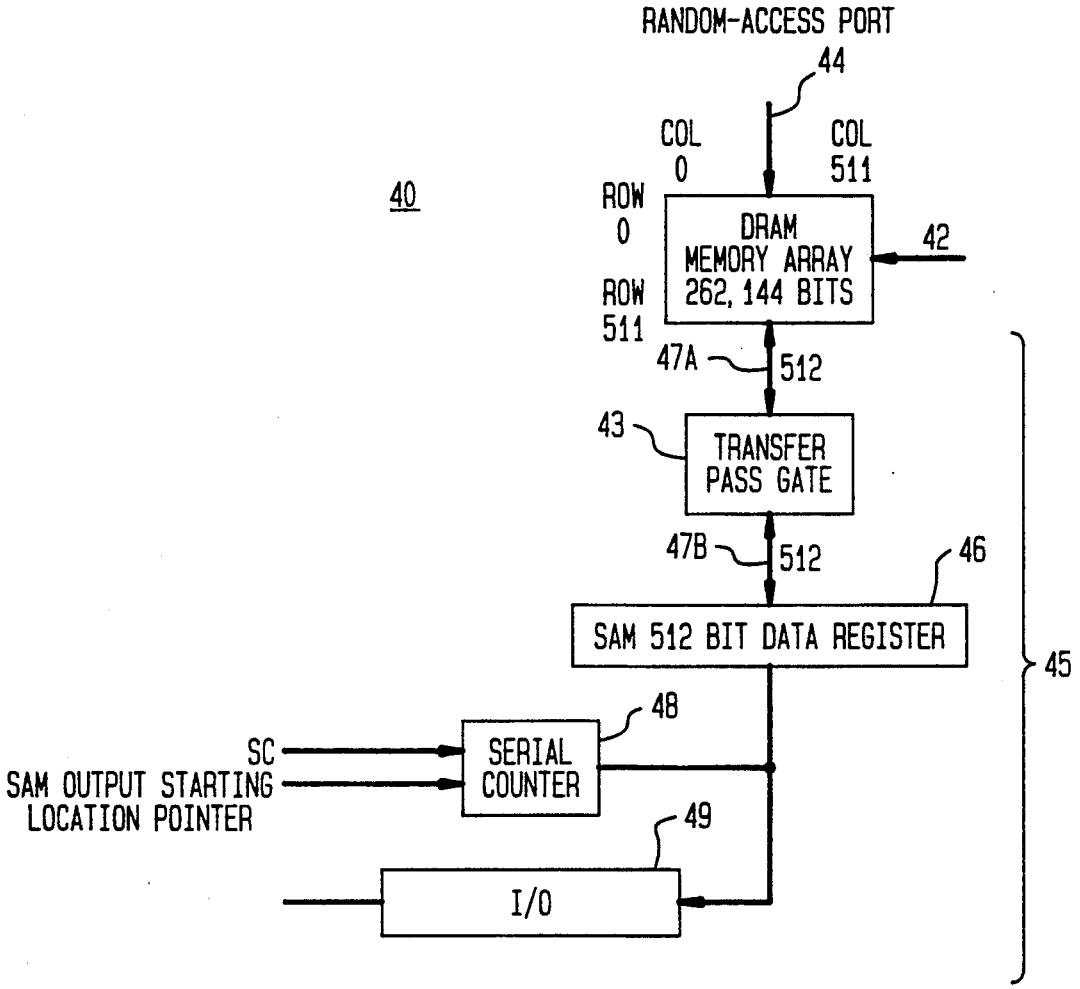
FIG. 2 schematically illustrates a VRAM with a serial port.
Figure 3:
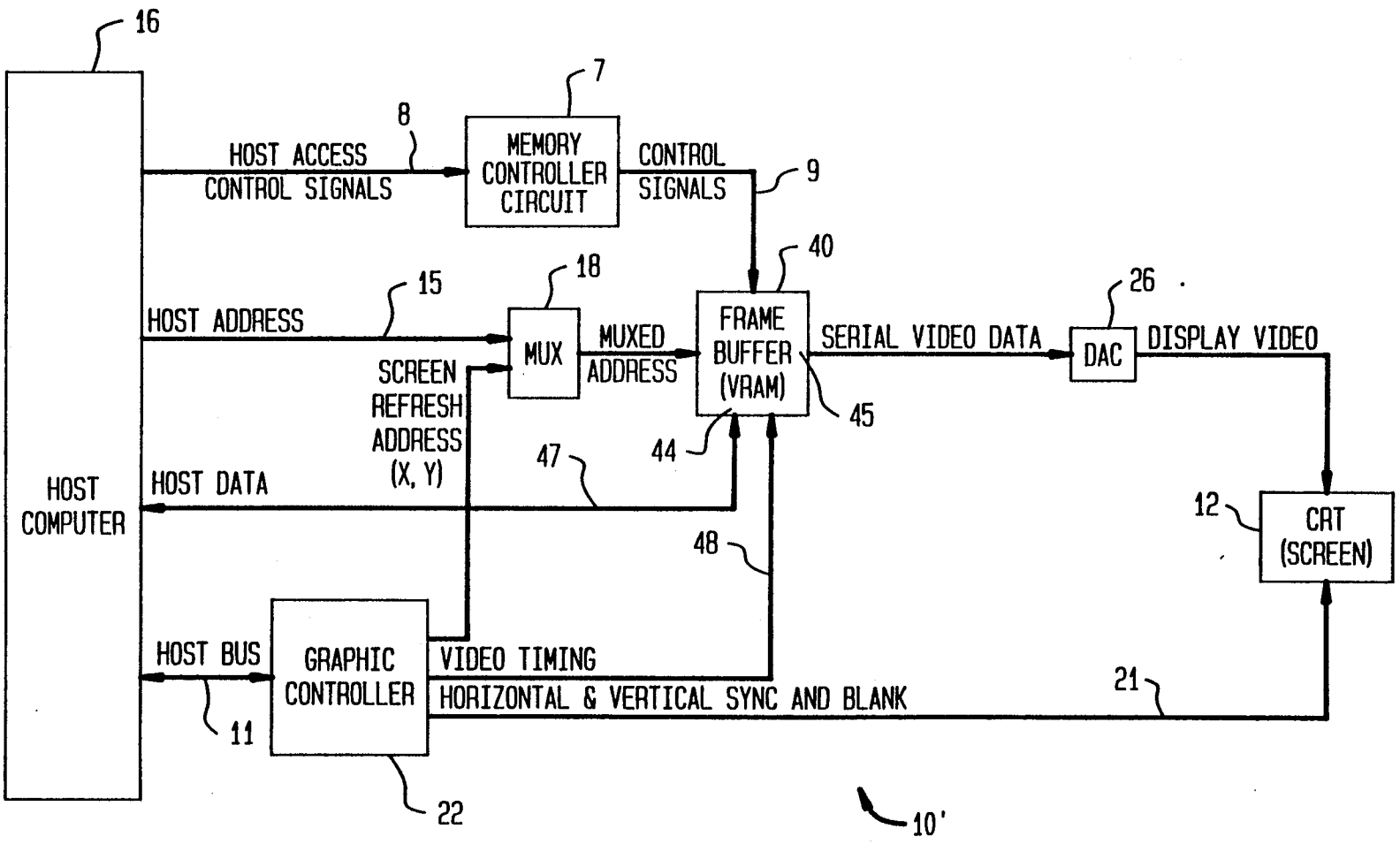
FIG. 3 schematically illustrates a conventional raster display system in which the frame buffer is implemented using the VRAM of FIG. 2.
Figure 4:
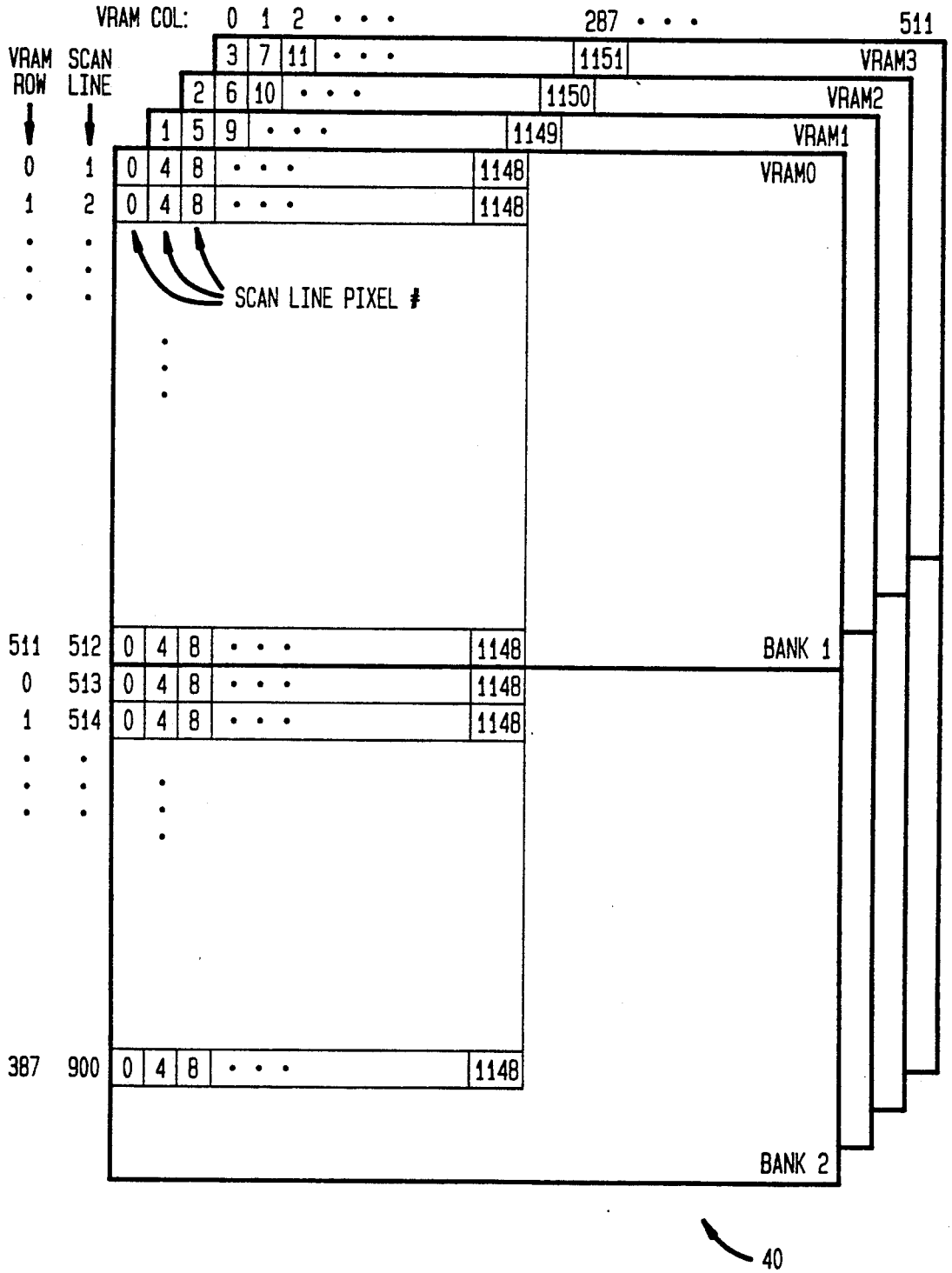
FIG. 4 illustrates one particular organization of data within the VRAM of FIG. 2.
Figure 6:
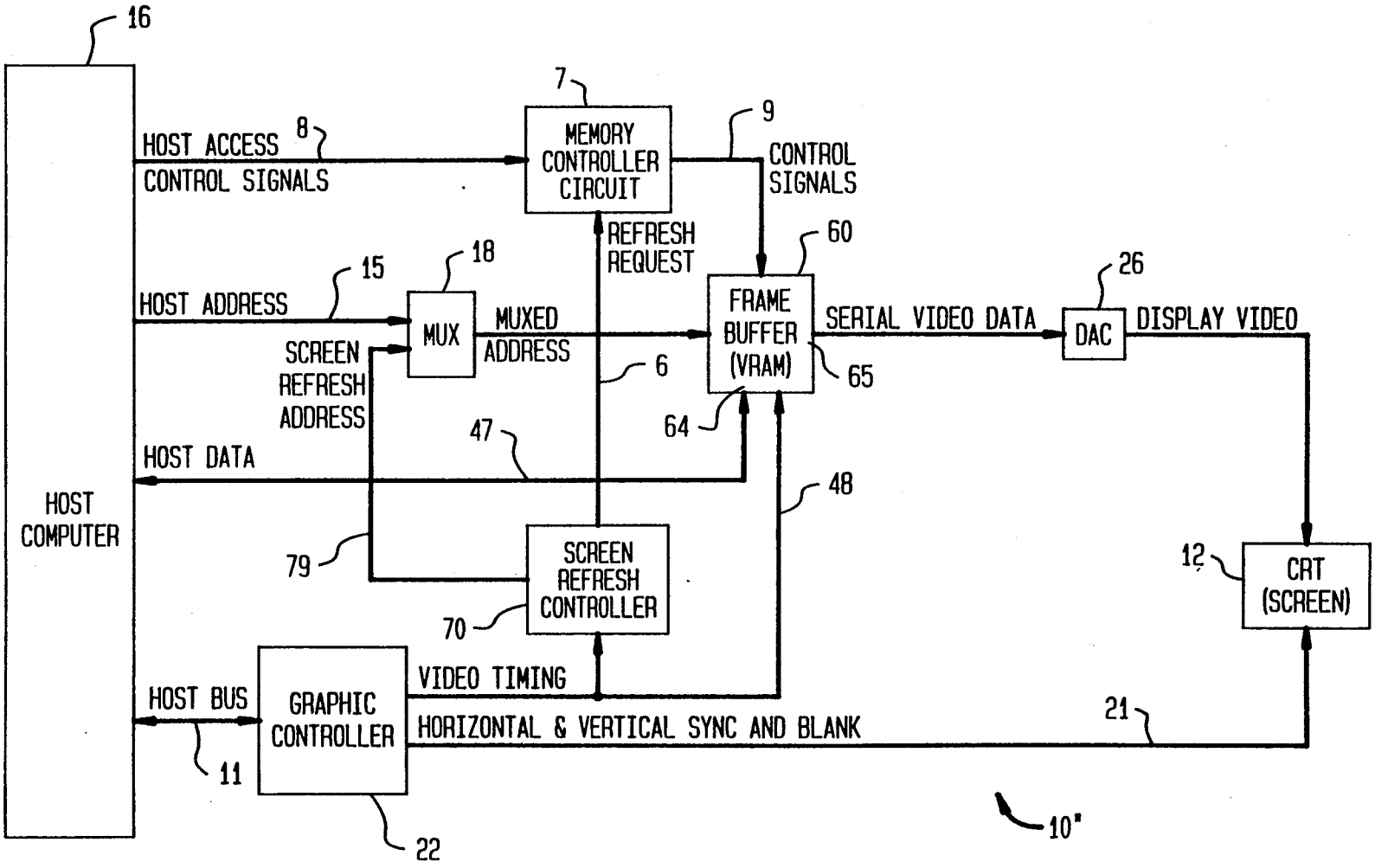
FIG. 6 schematically illustrates a raster display system in accordance with an illustrative embodiment of the present invention.

FIG. 6 schematically illustrates a raster display system 10″ in accordance with an illustrative embodiment of the invention. The system 10″ of FIG. 6 differs from the system 10′ of FIG. 3 in that the frame buffer of the system 10″ is implemented using a VRAM 60 with split row transfer capability rather than the VRAM 40 of FIG. 3 which has no split row transfer capability. In addition, the system 10″ of FIG. 6 comprises the screen refresh controller circuit 70. In the system 10″ of FIG. 6, addresses for screen refresh operations are generated by the screen refresh controller circuit 70 and transmitted via the bus 79 to the multiplexer 18. In order to properly carry out the screen refresh, the screen refresh controller 70 transmits a refresh request signal via line 6 to the memory controller circuit 7. In contrast, in the system 10′ of FIG. 3, addresses for screen refresh operations are generated by the graphic controller 22. In the system 10″ of FIG. 6, buffer refresh operations write data into the VRAM 60 via the random access port 64. Screen refresh operations read data out of the serial port 65.

As indicated above, the use of the VRAM 60 with split transfer capability and the use of the screen refresh controller circuit 70 enables the display system 10,, of FIG. 6 to make very efficient use of the memory capacity of the VRAM 60 and enables the system 10″ to be independent of the resolution of the specific screen 12 utilized in the system.

Figure 7:
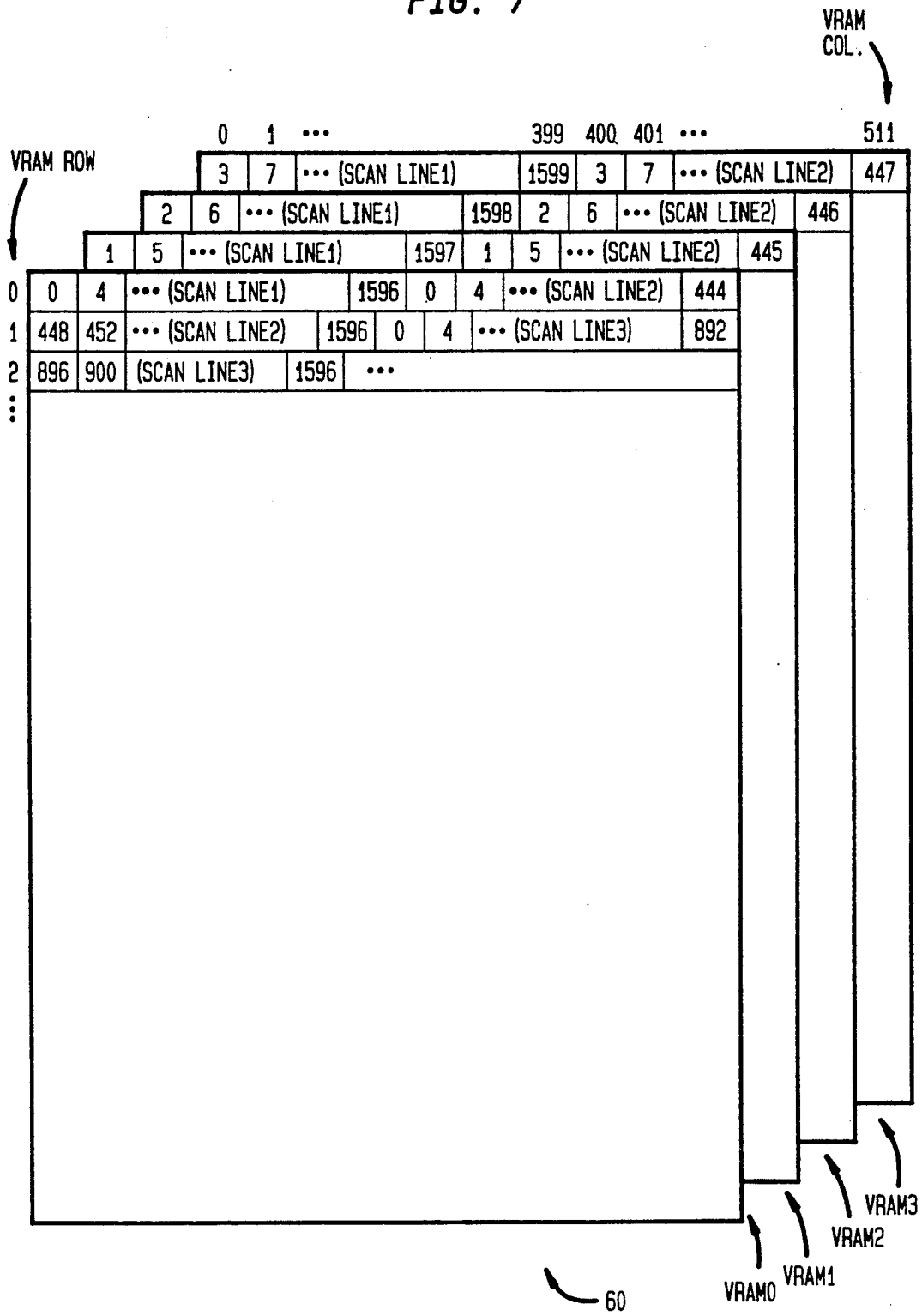
FIG. 7 illustrates the organization of data in VRAM of FIG. 6.

Using a VRAM capable of executing a split row transfer, the pixels of a VRAM may be stored in a linear address fashion. Such an arrangement is depicted in FIG. 7. Depicted therein are VRAMs 60 which support a split row transfer. The VRAMs 60 have rows labeled 0,1, . . . . Stored in the VRAMs 60 are the rows or scan lines of a display screen labeled 1,2, . . . . As depicted in FIG. 7, the pixel data of each scan line is stored adjacent to the previous scan line. The scan lines, not being an integral multiple of the VRAM 60 row width overlap onto the next line. For instance, row 0 of the VRAM 60 stores scan line 1 of the display screen and the first group of pixels of the scan line 2. The remaining pixels of scan line 2 overlap onto row 1 of the VRAM 60. Immediately adjacent to the remaining pixels of scan line 2 are the pixels of the scan line 3, and so on.

Figure 8:
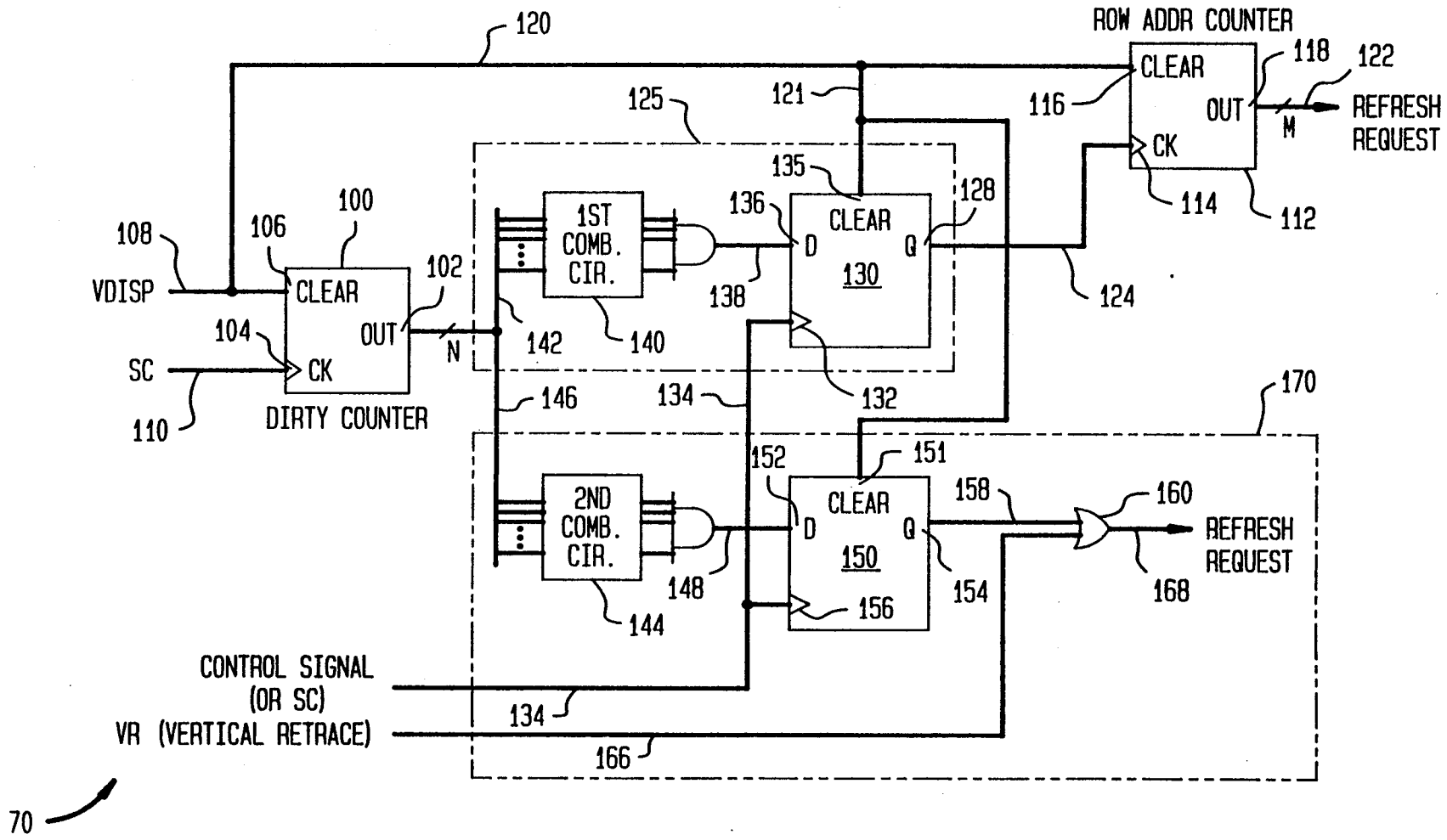
FIG. 8 schematically illustrates an address generator circuit for use in the raster display system of FIG. 6.

Turning now to FIG. 8, a screen refresh controller circuit 70, for refreshing a display screen stored in VRAMs 60 (FIG. 6) in a linear address format is depicted. The screen refresh controller comprises a dirty counter 100, having an output 102, clock input 104 and clear input 106. The clear input 106 is connected via a line 108 to the VDISP signal. Thus, the dirty counter 100 is cleared (reset to logic zero) during the vertical blanking interval. Illustratively, as discussed in greater detail below, the VDISP signal is also connected to memory controller 7 (FIG. 6) in order to determine whether an RDT or split row transfer should occur. The clock input is connected to a serial clock via line 110. The serial clock is illustratively generated by the graphic controller 22 (FIG. 6) and serves to synchronize the output of pixel data from the VRAMs 60 (FIG. 6) with the raster scan of the CRT 12 (FIG. 6). Thus, the dirty counter 100 starts at zero during a vertical blanking interval and increments with the serial clock. The dirty counter 100 returns to zero after it reaches the maximum column position of the VRAMs 60 (FIG. 6). Illustratively, to support VRAMs 60 (FIG. 6) having 512 columns, the dirty counter 100 counts from 0 to 511 and then goes back to 0.

The screen refresh controller 70 also has a row address counter 112. Like the dirty counter 100, the row address counter 112 has a clock input 114, a clear input 116 and an output 118. The clear input 116 is also connected to the VDISP signal via line 120. Thus, the row address counter 112 is reset (i.e. set to zero) during the vertical blanking interval. The output 118 is connected via line 122 and line 79 to the address multiplexer 18 (FIG. 6) and thereby to the VRAMs 60 (FIG. 6).

The clock input 114 of the row address counter 112 is connected via line 124 to a clock generator circuit 125. The purpose of the clock generator circuit 125 is to generate one clock sometime when the dirty counter 100 counts in the lower half of its count. Illustratively, the clock generator circuit comprises a combination circuit 140 and a flip-flop 130. The clock signal generated on line 124 is connected to the Q output 128 of the flip-flop 130. The flip-flop 130 also has a clock input 132 connected to the serial clock (SC) or another control signal Via line 134. The flip-flop 130 has a D input 136 connected via line 138 to the first combination circuit 140. The first combination circuit 140 is connected to the output 102 of the dirty counter 100 via lines 142. By means of the first combination circuit 140, a logic one is output on line 138 once when the dirty counter 100 counts in the lower half of its count. This may be achieved by ANDing the individual bits or their complements using AND gates and inverters in the first combination circuit 140. For instance, if it is desirable to set the flip-flop 130 when the dirty counter 100 reaches one hundred twenty-seven, the lower seven bits and the complements of the upper two bits are ANDed in the first combination circuit 140. This insures that a logic one is generated for one clock but only once during each count of the dirty counter 100. During the Video blanking interval, an impulse fed via line 121 to the clear input 135 of the flip-flop 130 resets the flip-flop.

The screen refresh controller 70 also has a refresh request generator circuit 170 for initiating a transfer cycle. The refresh request generator circuit 170 comprises a second combination circuit 144, a flip-flop 150 and an OR gate 160. The interconnection of these elements is now described in greater detail.

The second combination circuit 144 is connected to the output 102 of the dirty counter 100 via line 146. The second combination circuit 144 outputs a logic one once whenever the dirty counter 100 counts to the most significant location of the lower half of its count and once when it counts to the most significant location of the upper half of its count. Illustratively, the second combination circuit 144 outputs a logic one whenever the dirty counter 100 reaches two hundred fifty-five and five hundred eleven. To that end, the second combinational circuit 144 preferably ANDs the lower eight bits of the dirty counter 100 using AND gates. This generates a logic one for the duration of one clock cycle whenever the dirty counter 100 reaches two hundred fifty-five or five hundred eleven.

The second combination circuit 144 output is connected via line 148 to the D input 152 of the flip-flop 150. The flip-flop 150 has a Q output 154 and a clock input 156 connected via line 134 to the signal clock. By means of this arrangement, the flip-flop 150 stores a logic one output by the second combination circuit 144 when the dirty counter reaches two hundred fifty-five and five hundred eleven. Otherwise, the flip-flop 150 stores a logic zero. The flip-flop 150 illustratively delays the output of the second combination circuit 144. Thus, a logic one is generated in the flip-flop 150 when the dirty counter 100 reaches two hundred fifty-six and zero. As with the flip-flop 130, an impulse, transmitted by line 121 to the clear input 151 of the flip-flop 150 during the vertical blanking interval, resets the flip-flop 150 to logic zero.

The Q output 154 of the flip-flop 150 is fed via line 158 to an OR gate 160. The VR (vertical retrace) signal is input via line 166 to the OR gate 160. The output of the OR gate is the refresh request signal. It may be fed, via lines 168 and 6, to the memory controller circuit 7 to initiate a transfer cycle (a split row transfer or a read data transfer cycle).

Figure 9:
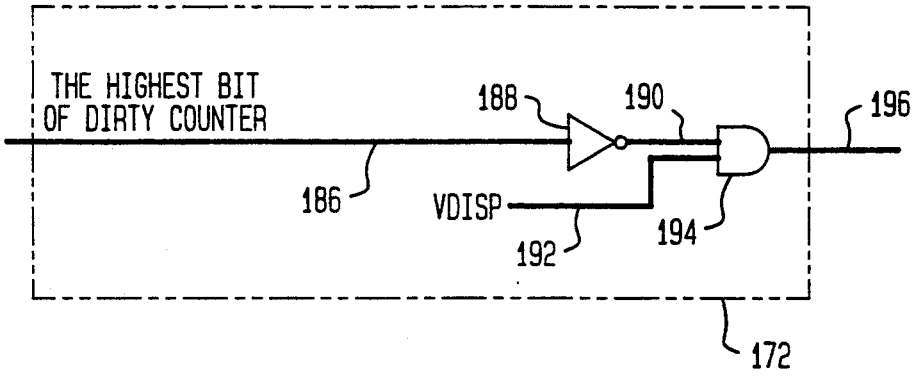
FIG. 9 schematically illustrates a tap pointer generator circuit for use in the address generator circuit of FIG. 8.

The screen refresh address generator circuit 70 also has a tap pointer generator circuit 172 as depicted in FIG. 9. Illustratively, the highest bit of the dirty counter 100 (FIG. 8) is fed via line 186 to an inverter 188. The output of the inverter 188 is fed via line 190 to an AND gate 194. This AND gate 194 also receives the VDISP signal as an input via line 192.

Figure 5A:
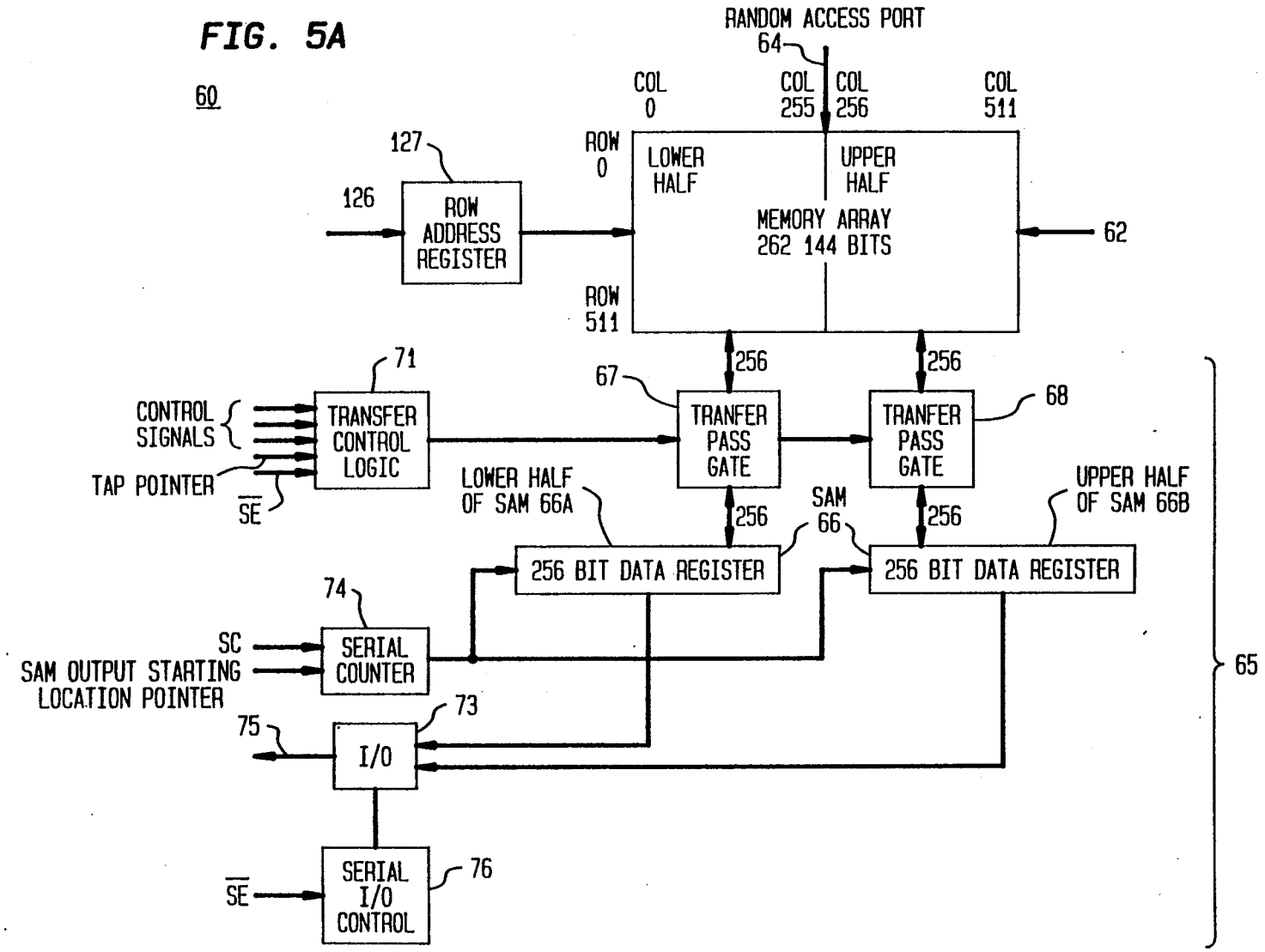
FIG. 5A schematically illustrates a VRAM with split transfer capability.

In the operation of the tap pointer circuit 172, the highest order bit of the dirty counter 100 (FIG. 8) is outputted via the line 186 as the value of the tap pointer generator 172 on line 196. The tap pointer generator output line 196 is, in turn, sent to the tap pointer input of the VRAMs 60 by way of MUX 18 (FIG. 6). The highest order bit of the dirty counter 100 (FIG. 8) is only set to logic one when the dirty counter is counting the pixels in the upper half of the SAM 66 (FIG. 5A). Thus, the value of the tap pointer is toggled depending upon whether the dirty counter 100 is counting in the upper half or lower half of its count. Illustratively, the tap pointer generator 172 is designed to output a logic zero on line 196 to point to the lower half of the SAM 66 (FIG. 5A). To point to the upper half of the SAM 66 (FIG. 5A) the tap pointer generator illustratively outputs a logic one on line 196. The line 196 is the high order bit of the tap pointer address. The rest of bits for the tap pointer address are set to logic zero.

The VDISP signal, fed by line 192 to the AND gate 194, is used to set the tap pointer to zero during the vertical blanking interval. The purpose of this arrangement is to hold the tap pointer at logic zero during an RDT operation which occurs during the vertical blanking interval. The sequencing of the tap pointer during the vertical blanking interval is explained in greater detail below.

Figure 10:
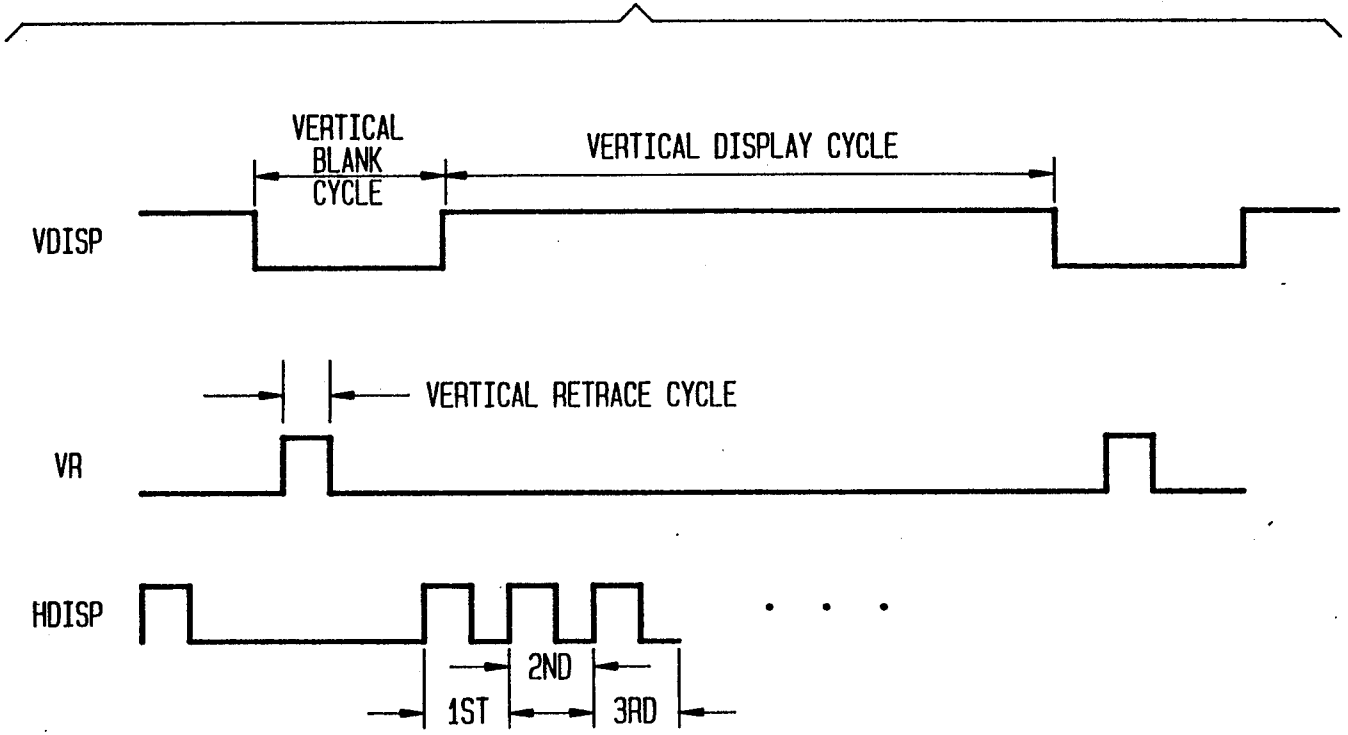
FIG. 10 illustrates the timing of split transfer and read data transfer operations in the VRAM of FIG. 6.

The operation of the refresh address generator circuit 70 of FIGS. 8–9 is now described in conjunction with FIG. 10. FIG. 10 depicts the relationship of certain video timing signals. First a video blanking interval occurs in the VDISP signal. Thus, the dirty counter 100, row address counter 112 and the flip-flops 130, 150 are reset to logic zero. Next, during the video blanking interval, a pulse appears in the VR signal initiating a vertical retrace on the display screen. At this time, it is desireable to perform a RDT rather than a split row transfer. Thus, by means of the OR gate 160, the refresh request generator can generate a refresh request. The VDISP signal, which is illustratively connected, via the memory control cicuit 7 (FIG. 6), to a control input of the VRAMs 60 (FIG. 6) generates an appropriate signal to indicate that an RDT, rather than a split row transfer, should occur. Further, the tap pointer is preferably held at logic zero during the RDT. By means of the AND gate 194 (FIG. 9) the tap pointer is held at logic zero. The refresh request signal, fed to an appropriate input of the memory controller circuit 70 (FIG. 6), then causes a RDT.

After the RDT, row 0 of the DRAM 62 (FIG. 5A) is in the SAM 66 (FIG. 5A). At the end of the vertical blanking interval, pulses appear in the HDISP signal.

The serial clock synchronizes with these pulses. As the serial clock receives pulses, pixel data are shifted out one by one from the SAM 66 (FIG. 5A). Additionally, the dirty counter 100 is incremented on each pulse of the serial clock. In this way, the dirty counter 100 indicates which pixel datum has shifted out of the SAM 66 (FIG. 5A). Some time during the lower half of the dirty counter's 100 count, the first combinational circuit 140 outputs a logic one. This output is clocked into the flip-flop 130. With the flip-flop 130 changing its state, the row address counter 112 is incremented from zero to one. Thus, the frame buffer 60 (FIG. 5A), now receives the value one as a row address input.

The dirty counter 100 indicates that the pixel data of the lower half of the SAM 66 (FIG. 5A) have all been shifted out when it reaches the most significant location of the lower half of the SAM 66 (FIG. 5A). At this point, the lower half of the SAM 66 (FIG. 5A) may be loaded with the next half row of data from the DRAM 62 (FIG. 5A). When the count of the dirty counter 100 has reached this value, the second combination circuit 144 outputs a logic one. The output of the combination circuit 144 is clocked into the flip-flop 150. The value of the flip-flop 150 (now a logic one) is ORed with the VR signal to produce a logic one. Additionally, the VDISP signal, which is also illustratively connected to the memory controller circuit 7 (FIG. 6) now indicates that a split row transfer, rather than an RDT, should occur. Thus, a split row transfer of the half row pointed to by the tap pointer is initiated. Since the highest bit of the dirty counter 100 is now a logic one (i.e., the dirty counter 100 has reached two hundred fifty-six), the tap pointer generator circuit 172 (FIG. 9) outputs a logic zero. Thus the tap pointer points to the lower half of the SAM 66 (FIG. 5A) indicating that the split row transfer should occur on the lower half of the addressed row of the DRAM 62 (FIG. 5A). Thus, the lower half of row 1 of the DRAM 62 (FIG. 5A) is transferred to the lower half of the SAM 66 (FIG. 5A).

Meanwhile, the SAM 66 (FIG. 5A) continues to serially shift out the pixel data stored in its upper half (i.e. the upper half of DRAM row zero). It may be appreciated that the SAM 66 (FIG. 5A) will shift out all the pixel data of scan line 1 of the display screen 12 (FIG. 6). At this point, the next pixel data of the SAM 66 (FIG. 5A) to be serially outputted must be displayed on scan line 2 of the display screen 12 (FIG. 6). Prior, to shifting out the remaining pixel data of the SAM 66 (FIG. 5A) a horizontal blanking interval occurs as the raster of the display moves to column location 0 of scan line 2. During the horizontal blanking interval, the serial clock is disabled so no pixel data is shifted out of the SAM 66 (FIG. 5A).

Eventually, the SAM 66 (FIG. 5A) reaches the last pixel stored in its upper half (i.e. the last pixel of DRAM row zero). Illustratively, for a 512×512 VRAM 60 (FIG. 6) this corresponds to column five hundred eleven of the SAM 66 (FIG. 5A). At the same time the dirty counter 100 reaches five hundred eleven of its count. Thus the highest bit of the dirty counter 100 is set to logic zero in the next serial clock (FIG. 9). Meanwhile, the second combination circuit 144 outputs a logic one which is stored in the flip-flop 150 in the next serial clock. By means of the flip-flop 150 and the OR gate 160, the screen refresh request generator 170 outputs a logic one. As before, a split row transfer is initiated. The row address counter, however, still points to row 1 of the VRAM 60 (FIG. 6) so one half of row 1 will be transferred to the SAM 60 (FIG. 5A). This time, however, the tap pointer generator circuit 172 (FIG. 9) outputs a logic one (by virtue of the highest bit of the dirty counter 100 being zero) which points to the upper half of the addressed row. Thus, a split row transfer occurs moving the upper half of DRAM row 1 to the upper half of the SAM 66 (FIG. 5A).

In the meantime, the dirty counter 100 returns to zero and pixel data are serially shifted out of the lower half of the SAM 66 (FIG. 5A) which, as previously indicated, now contains the lower half of DRAM row 1. It may be appreciated that the two above-mentioned split row transfers will occur again when the dirty counter 100 reaches two hundred fifty-five and five hundred eleven, respectively. Thus, for every row, two split row transfers occur. First, when the SAM 66 (FIG. 5A) begins shifting out the pixel data of the upper half, the lower half row of pixel data of the next row of the VRAM 60 (FIG. 6) is transferred to the lower half of the SAM 66 (FIG. 5A). Then, when the SAM 66 (FIG. 5A) begins shifting out the pixel data of the lower half, the pixel data of the upper half of the current row of the VRAM 60 (FIG. 6) is transferred to the upper half of the SAM 66 (FIG. 5A). This process occurs until all of the display screen scan lines are displayed. At this point a vertical blanking interval occurs within the VDISP signal and an RDT transfer, as described above, occurs. The whole screen refresh process then repeats itself.

Figure 11:
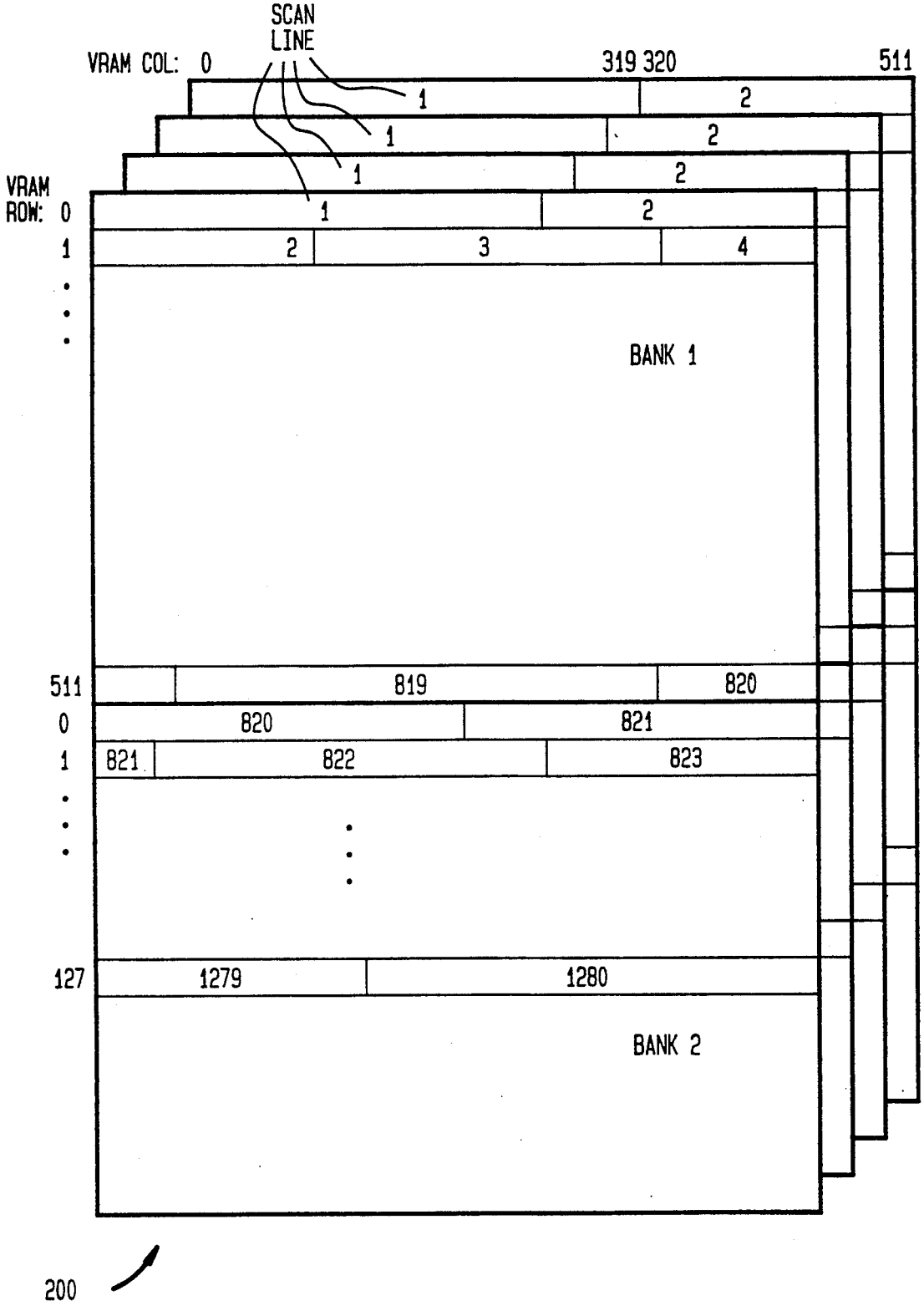
FIG. 11 illustrates data organization in a VRAM system comprising two banks.

Turning now to FIG. 11, a storage arrangement 200 for a 1024*1280 display screen 12 (FIG. 6) using 256K*4 VRAMs 60 (FIG. 6) is shown. The storage of pixels is in four memory arrays labeled VRAM0, VRAM1, VRAM2, VRAM3 using linear addressing as described in conjunction with FIG. 7. In this case, the number of pixels in the display screen 12 (FIG. 6) exceeds the number of locations in one bank of memory arrays. Hence, as shown in FIG. 11, two banks of memory arrays labeled BANK 1 and BANK 2 are shown. The pixel data overlap from the last row, 511, of BANK 1 to the first row, 0, of BANK 2. In other words, the pixel data of scan lines 1,2, . . . , 819 are stored linearly in BANK 1. The first two hundred fifty-six pixels of scan line 820 are also stored in a BANK 1. The latter 1024 pixels of scan line 820 are stored in row 0 of BANK 2. Thereafter, the storage of scan lines 821–1024 continues in BANK 2 in a linear fashion.

Before, the row address counter 112 (FIG. 8) counted the rows of the VRAMs 60 (FIG. 6). Using one bank of 256K*4 VRAMS 60 (FIG. 6), which illustratively had 512 rows, the row address counter 112 (FIG. 8) needed only nine bits. With two banks, ten bits are used. The highest order bit is used to select the correct bank, i.e. BANK 1 OR BANK 2. This may be accomplished by decoding the tenth bit and inputting the resulting decoded signal to the chip select lines of the VRAMs 60 (FIG. 6) of each bank. An exemplary bank selector circuit 210 is shown in FIG. 12.

Figure 12:
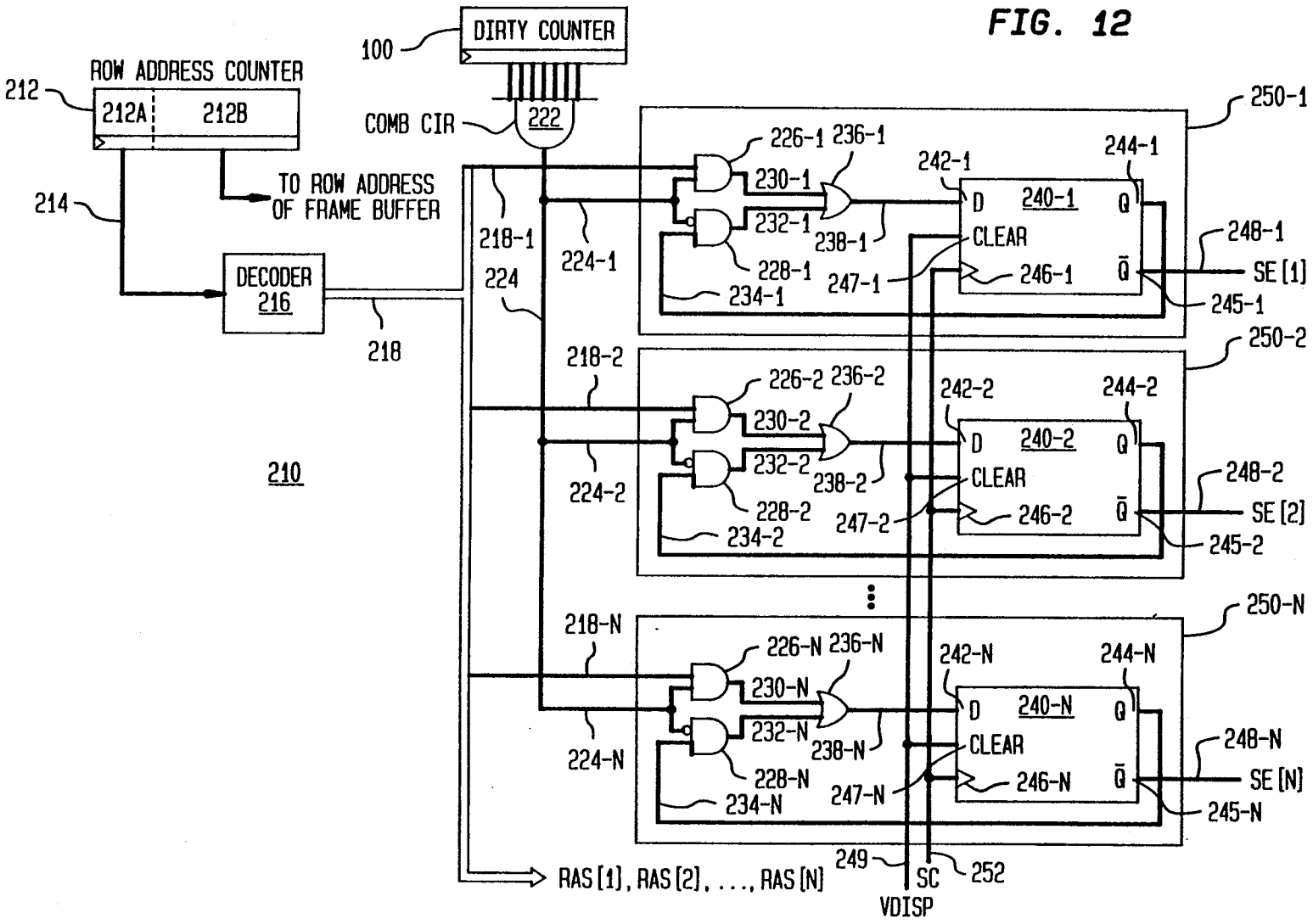
FIG. 12 schematically illustrates an optional bank switching circuit for use in the address generator circuit of FIG. 8.

Referring now to FIG. 12, the bank selector circuit 210 is now described. As shown in FIG. 12, a modified row address counter 212 is divided into two portions, the higher order bits 212A and the lower order bits 212B. The lower order bits 212B are used as previously described to address the rows of the VRAMs 60 (FIG. 6). The higher order bits 212A are fed to the bank selector circuit 210 via line 214.

The higher order bits 212A are input via line 214 to a decoder 216 which decodes the bits 212A from binary to unary format. From this point, each unary output line 218-1, . . . , 218-N is fed to the input enable (labeled RAS in FIG. 12) to enable the reception of the row address by the VRAMs 60 (FIG. 6) of the particular banks. For instance, a row address counter 212 having thirteen bits and designed to support 512×512 VRAMs has an extra four higher order bits 212A. These bits 212A may be used to select the VRAMs 60 (FIG. 5A) of one of sixteen banks to receive the row address. This is accomplished by inputting the higher order bits to a decoder 216 and running each unary output line 218-1,218-2, . . . , 218-16 to the corresponding bank select signal RAS[1],RAS[2], . . . , RAS[16]. When there are only two banks, only one bit 212A is needed.

Figure 5B:
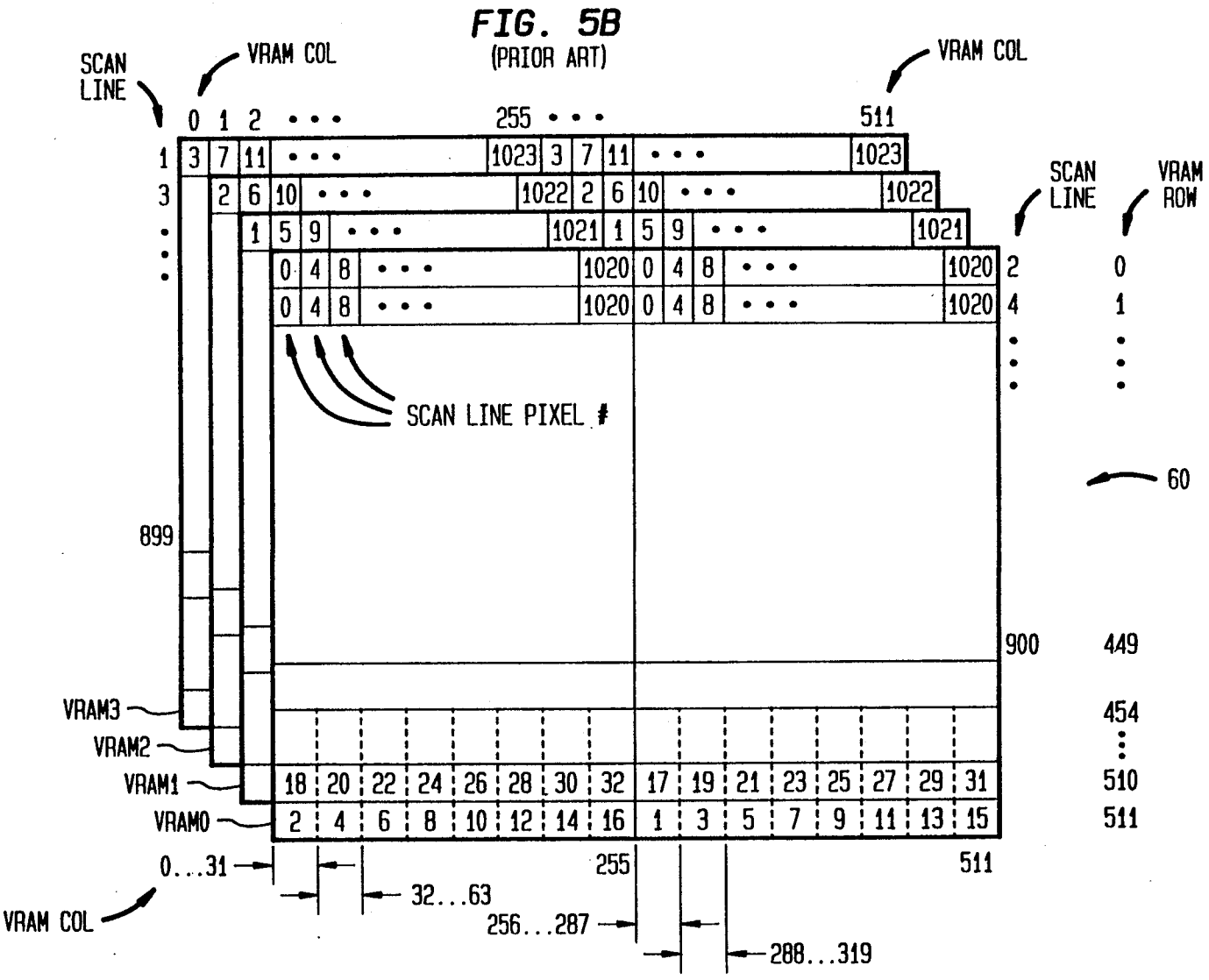
FIG. 5B (PRIOR ART)
FIG. 5B illustrates one particular organization of data within the VRAM of FIG. 5A.

It may be appreciated that not only must the row address input of the banks be disabled but the output of the SAMs 66 (FIG. 5) of the VRAMs 60 (FIG. 6) of each bank not selected must also be disabled. To achieve this end, a more complicated arrangement is necessary to ensure that the bank output is disabled only when the SAM 66 (FIG. 5A) of that bank has outputted the last row of pixel data.

A plurality of circuits 250-1, . . . , 250-N respectively connected to unary output lines 218-1, . . . , 218-N are provided to perform this task. Each circuit 250-1, . . . , 250-N is designed to control the serial output of the VRAMs 60 (FIG. 6) of one bank corresponding to the unary line 218-1, . . . , 218-N inputted to the circuit 250-1, . . . , 250-N. Illustratively, each circuit 250-1, . . . , 250-N has an output 248-1, . . . , 248-N which is fed to the serial enable input (SE) of the VRAMS 60 (FIG. 6) in the associated bank. The SE input controls, among other things, the serial output of each VRAM 60 (FIG. 6). The operation of circuits 250-1 and 250-2 are now discussed although the discussion holds for all of the circuits 250-1, . . . , 250-N.

The lowest order unary output is input via line 218-1 to an AND gate 226-1. This output of line 218-1 illustratively corresponds to the first bank and is a logic one when BANK 1 is selected. Preferably, this occurs when none of the bits 212A are equal to a logic one. Also input to the AND gate 226-1 via line 224-1 is the output of a combination circuit 222. This combination circuit 222 ANDs all of the bits of the dirty counter 100. The combination circuit thus outputs a logic one on line 224 when the dirty counter reaches the end of its count, i.e., when the SAM 66 (FIG. 5A) has output its last pixel datum. This is desireable in the preferred embodiment to ensure that the AND gate 226-1 can only output a one when the SAM 66 (FIG. 5) has output the last pixel datum.

Circuit 250-1 has a second AND gate 228-1. The complement of the combination circuit 222 output, also fed via line 224-1, is inputted to the AND gate 228-1. Also input to the AND gate 228-1 is the Q output 244-1 of a flip-flop 240-1 fed via feed back path 234-1. Thus, the gate 228-1 outputs a logic one when the dirty counter 100 has not reached the end of the SAM 66 (FIG. 5A) and when the flip-flop 240-1 is already set to logic one.

The outputs of the AND gates 226-1, 228-1 are fed, respectively, via lines 230-1, 232-1 to an OR gate 236-1. The OR gate outputs a logic one if either of the AND gates 226-1, 228-1 outputs a logic one. The output of the OR gate 236-1 is fed via line 23B-1 to the D input 242-1 of the flip-flop 240-1.

The flip-flop 240-1 has a clock input 246-1, a Q output 244-1 a $\overline{Q}$ (complement) output 245-1, and a clear input 247-1. The clock input 246-1 is connected via line 252 to the serial clock or other control signals. Thus, the storage of the flip-flop 240-1 is synchronized with the dirty counter 100. The Q output 244-1 is inputted, via feedback path 234-1, to the AND gate 228-1. The $\overline{Q}$ output 245-1 is fed, via line 248-1 to the serial enable (SE[1]) of BANK 1 (FIG. 11). Finally, the clear input 247-i is connected, via line 249 to the VDISP signal.

The operation of the circuit 250-1 is as follows. Initially, the vertical blanking interval of the VDISP signal clears all of the flip-flops 250-1, 250-2, . . . , 250-N. While the high order bits 212A of the row address counter 212 equal a logic zero, it is desireable to access the pixel data of BANK 1 (FIG. 11). Therefore, after the vertical blanking interval, the flip-flop 240-1 is set to a logic one and the other flip-flops 240-2, . . . , 240-N are set to zero. Thus, SE[1] is equal to a logic zero and SE[2]], . . . , SE[N] are equal to a logic one. The SE[1] enables the serial output of BANK 1 (FIG. 11) while the serial outputs of the other banks are disabled.

As mentioned before, the row address counter 212 is incremented once some time while the SAM 66 (FIG. 5A) outputs the pixel data of the lower half of each row in the VRAM 60 (FIG. 6). Hence, while the SAM 66 (FIG. 5A) outputs the pixel data of the last row of the VRAMs 60 (FIG. 6) of BANK 1 (FIG. 11), the row address counter 212 is incremented. At this point, the row address portion (i.e. the lower order bits) 212B addresses row 0 and the bank select portion now selects BANK 2 (FIG. 11). Thus, the decoder 216 outputs a logic one on line 218-2 and zero on the others 218-1,218-3,218 4, . . . , 218-N.

When the SAM 66 (FIG. 5A) outputs its last pixel datum, the dirty counter 100 has reached the end of its count. All of its bits are now equal to a logic one and the combination circuit 222 outputs a logic one. In the AND gate 226-1, a logic one on line 224-1 and logic zero on line 218-1 are received. In response to this, the AND gate 226-1 outputs a logic zero which is fed via line 230-1 to the OR gate 236-1. In the AND gate 228-1, the inverted output of the combination circuit 222 (equal to a logic zero and the Q output of the flip-flop 240-1 (equal to a logic one) are received. The AND gate 228-1, thus also outputs a logic zero to the OR gate 236-1. Thus, the OR gate outputs a logic zero to the D input of the flip-flop 240-1 which stores a logic zero on the next clock. From then on, the AND gate 228-1, which receives the logic zero value of the flip-flop, 240-1 cannot set the flip-flop 240-1 to a logic one. Only the AND gate 226-1 can set the flip-flop 240-1 to a logic one. This can only occur, when the higher order bits 212A of the row address counter 212 select BANK 1 (FIG. 11) (i.e. are all logic zero) and when the dirty counter 100 reaches the end of its count.

Meanwhile, line 218-2 carries a logic one signal. Line 218-2 and the combination circuit 222 output, fed via line 224-2, are inputted to the AND gate 226-2 of the circuit 250-2. This AND gate 226-2 outputs a logic one. The AND gate 228-2 outputs a logic zero as its Q output 244-2 (as stated before) is a logic zero. These AND gate 226-2, 228-2 outputs are received by an OR gate 236-2 which outputs a logic one to the D input 242-2 of the flip-flop 240-2. Thus on the next clock, the flip-flop 240-2 is set to a logic one and remains at this state until the bits 212A of the row address counter 212 change and the dirty counter 100 reaches the end of its count. This is by virtue of the AND gate 228-2 which receives a logic one from the Q output 244-2 and a logic one from the complemented output of the combination circuit 222. With the flip-flop 240-2 set to a logic one, a logic zero is output on line 248-2 which carries the SE[2] signal.

Thus, when the row address counter 212 reaches a value corresponding to a different bank (bits 212A change) and the SAM 66 (FIG. 5A) has output its last pixel datum, a different serial enable signal of SE[1]-,SE[2], . . . , SE[N] outputs a logic zero. Only one SE signal outputs a logic zero at a particular time; the rest output a logic one. Thus, the output of the VRAMs 60 (FIG. 6) of different banks are alternatively selected.

The screen refresh controller circuit 70 may also be modified to support either double buffering or interlaced scanning. Double buffering is a pixel data storage arrangement using two frame buffers. While a first frame buffer is displayed on the display screen 12 (FIG. 6) the CPU 16 (FIG. 6) may access the data of the second buffer without interruption. After the display of the first frame buffer on the display screen 12 (FIG. 6) is completed, the first frame buffer is then made available to the CPU 16 (FIG. 6) for access. The second buffer, formerly available for access by the CPU 16 (FIG. 6), is then displayed on the display screen 12 (FIG. 6). In this arrangement, the CPU 16 (FIG. 6) may alternatively prepare one screen of data for display in one buffer without interruption while the other buffer is displayed.

Interlaced scanning is a method of displaying the pixel data of two frame buffers alternatively on a screen to generate a picture at a lower refresh rate without flicker. Illustratively, the scan lines of the screen are labeled from one to the number of the last scan lie of the screen. These scan lines are separated into two fields, an even field and an odd field. The even field comprises the even scan lines and the odd field comprises the odd scan lines. In the refreshing of the screen, the odd and even fields are alternatively displayed on the screen.

Figure 13:
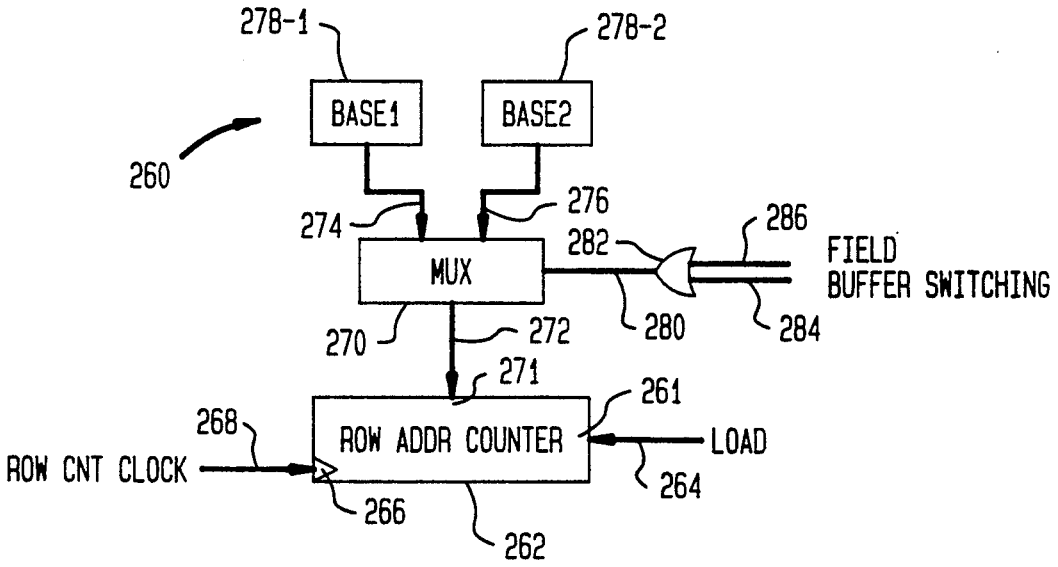
FIG 13 depicts a modified row address counter circuit for use in interlaced scanning and double buffering.

An exemplary circuit 260 depicted in FIG. 13 supports both double buffering and interlaced scanning. The circuit 260 comprises a modified row address counter 262 which has a clock input 266 connected to an externally supplied clock via line 268. Preferably, this clock is generated in a similar manner as the clock 114 for the row address counter 112 of FIG. 8.

Additionally, the row address counter 262 has a load signal input 261 which is connected to a load signal via line 264. Preferably, the load input 261 is provided instead of a clear input such as the clear input 116 of the row address counter 112 of FIG. 8. The row address counter 262 further has an input 271 for receiving an inputted value via line 272. The modified row address counter 262 is designed to load the value of line 272 into the counter when a load signal is triggered on line 264. This value then serves as the row address counter 262 value. Illustratively, the load signal is the VDISP signal so that a load is triggered during each vertical blanking interval.

Connected to the load input 271 via line 272 is the output of a multiplexer 270. Illustratively, the multiplexer receives a one-bit selection control signal on line 280. In response to this section control signal, the multiplexer selects either the value input on line 274 or the value input on line 276. Illustratively, these lines 274, 276 feed the output, respectively, of the base address registers 278-1 and 278-2.

These registers store the starting address, including the proper bank, of the first row of a distinct frame buffer or field. For example, the register 278-1 may store the first row address of the odd field and the register 278-2 may store the first row address of the even field of an interlaced image. Alternatively, the register 278-1 may store the first row address of a first buffer and the register 278-2 may store the first row address of a second buffer in a double buffering arrangement. It may be appreciated that the same circuit 260 may support either double buffering or interlaced scanning with the proper graphics controller 22 (FIG. 6).

The selector control bit of the multiplexer 270 is generated by an OR gate 282. This OR gate 282 receives a field selector input signal on line 286 and a buffer switching control signal on line 284. Thus, the circuit 260 may support both interlaced scanning and double buffering depending on the mode of operation of the refresh address generator circuit 70.

The operation of the circuit 260 will now be discussed. In a double buffering arrangement, when it is desired to display a first buffer on the display screen, an appropriate signal is generated on line 284. Alternatively, in an interlaced scanning arrangement, if it is desired to display the odd field of an image, an appropriate signal is generated on line 286. For instance, to display a first buffer, a logic zero may be inputted on line 284. Alternatively, to display the odd field, a logic zero may be inputted on line 286. The output of the OR gate 282 is inputted via line 280 to the multiplexer 270 which selects one of the two base addresses of the registers 278-1, 278-2 for output. Illustratively, for an odd field or first buffer selection, the base address of register 278-1 is selected.

Meanwhile, a load signal is generated on line 264. This causes the row address counter to load the selected value of the multiplexer appearing on line 272. From thence, this address will be used to address the VRAMs 60 (FIG. 6).

In a double buffering arrangement, the display of the second buffer 35 typically follows the display of the first buffer on the next screen refresh. When it is desired to display the second buffer, an appropriate signal (e.g., a logic one) is generated on line 284 to select the row address of the second register 278-2. Alternatively, in an interlaced scanning arrangement, after the odd field has been displayed, and a second screen refresh needs to be performed, the even field is typically displayed. To that end an appropriate signal (e.g., a logic one) is generated on line 286 to select the row address of the second register 278-2. Again, a load signal is simultaneously generated on line 264 causing the row address register 262 to load this value as a base address.

In short, a raster display system which makes efficient use of memory capacity and which is independent of screen resolution has been disclosed. Finally, the above-described embodiments of the invention are intended to be illustrative only. Numerous alternative embodiments may be devised by those skilled in the art without departing from the spirit and scope of the following claims.

We claim:

1. A screen refresh controller for a video memory having a row addressable storage means for linearly storing pixel data therein and a serial access memory for sequentially outputting one row of pixel data retrieved from the storage means, said controller comprising:

a first counter for counting the location of the last pixel datum output from the serial access memory;

a second counter for addressing the next row of pixel data of the storage means to be transferred into the serial access memory, said second counter being incremented in response to said first counter counting in a lower half of its sequence;

a tap pointer generating means for indicating that a lower half of an addressed row of the storage means be transferred to a lower half of the serial access memory in response to the first counter counting in an upper half of its sequence and that an upper half of an addressed row of the storage means be transferred to an upper half of the serial access memory in response to the first counter counting in a lower half of its sequence; and a screen refresh request generator means responsive to said first counter for enabling the transfer of said lower half or upper half of an address row indicated by said tap pointer generating means once during each half of the first counter sequence.

2. The controller of claim 1 further comprising:

a combination circuit having a plurality of AND gates for ANDing together individual bits of said first counter; and a flip-flop connected to said combination circuit, said flip-flop having an output connected to a clock input of said second counter, said flip-flop generating a single clock, in response to said first counter counting in the lower half of its count, to increment said second counter.

3. The controller of claim 1 wherein said screen refresh request generator means comprises:

a combination circuit having a plurality of AND gates for ANDing together all of the individual bits of said first counter except the highest bit; and a flip-flop connected to said combination circuit, said flip-flop generating a single split row transfer signal in response to said first counter counting in the upper half of its count and in response to said first counter counting in the lower half of its count.

4. The controller of claim 1, wherein said tap pointer generator means comprises an AND gate receiving the complement of said highest bit of said first counter and a vertical display signal as inputs, for generating a pointer to the lower half of an addressed row while said first counter counts in the upper half of its count, for generating a pointer to the upper half of an addressed row while said first counter counts in the lower half of its count and for disabling said complemented first counter bit output during a vertical blanking interval of said vertical display signal.

5. The controller of claim 1 wherein said video memory comprises more than one bank, said linearly stored pixel data continuing from bank to bank, said controller further comprising:

a bank select generating means responsive to said first and second counters for enabling the operation of a second bank containing the next row of data when the outputting of the last row of data from a first bank is complete.

6. The controller of claim 5 wherein said bank select generating means comprises:

a decoder means responsive to said second counter for separating a group of high order bits of a row address, for enabling the appropriate video memory bank in response thereto and for transmitting the remaining address bits to the enabled video memory bank.

7. The controller of claim 1 wherein said second counter further comprises a load means for loading a particular base address into said second counter in response to a vertical blanking interval.

8. The controller of claim 7 wherein said counter is capable of alternating the interlaced display of an even field of data and an odd field of data, wherein said load means of said second counter alternatively loads a base address of odd and even data fields into said second counter in response to a vertical blanking interval.

9. The controller of claim 7 wherein said counter is capable of alternating the display of a first buffer and a second buffer, wherein said load means of said second counter loads a base address of one buffer for display during the vertical blanking interval following the display of the other buffer.

10. A video display system comprising:

a display device of arbitrary resolution;

a video driver circuit connected to said display device;

a screen refresh controller for a video memory connected to said video driver circuit and having a row addressable storage means for linearly storing pixel data therein and a serial access memory for sequentially outputting one row of pixel data retrieved from the storage means, said controller comprising:

a first counter for counting a location of a last pixel datum output from the serial access memory;

a second counter for incrementally addressing a next row of pixel data of the storage means to be transferred into the serial access memory in response to said first counter counting in a lower half of its sequence;

a tap pointer generating means for indicating that a lower half of an addressed row of the storage means be transferred to a lower half of the serial access memory in response to the first counter counting in an upper half of its sequence and an upper half of an addressed row of the storage means be transferred to an upper half of the serial access memory in response to the first counter counting in the lower half of its sequence; and a screen refresh request generator means responsive to said first counter for enabling the transfer of said lower half or upper half of an address row indicated by said tap pointer generating means once during each half of the first counter sequence.

11. A method for operating a video display system comprising a display device of arbitrary resolution, a video driver circuit connected to the display device and a screen refresh controller for outputting pixel data from a video memory connected to said video driver circuit and having a row addressable storage means for linearly storing data therein and a serial access memory for sequentially outputting one row of pixel data retrieved from the storage means, said method comprising the steps of:

using a first counter, counting a location of a last pixel datum output from the serial access memory;

using a second counter, incrementally addressing a next row of pixel data of the storage means to be transferred into the serial access memory in response to counting locations in a lower half of the serial access memory; and under the control of a tap pointer, transferring a lower half of an addressed row of the storage means to a lower half of the serial access memory in response to said first counter counting locations in an upper half of the serial access memory and transferring an upper half of an addressed row to an upper half of the serial access memory in response to said first counter counting in a lower half of the serial access memory, a transfer of a half row of said storage means indicated by said tap pointer to said serial access memory taking place once during each half of a sequence of said first counter and being enabled by screen refresh request generator means responsive to said first counter.

* * * * *